US007482759B2

(12) United States Patent
Yoneyama et al.

(10) Patent No.: US 7,482,759 B2
(45) **Date of Patent: *Jan. 27, 2009**

(54) DRIVER CIRCUIT FOR LIGHT EMITTING ELEMENT

(75) Inventors: Teru Yoneyama, Kanagawa (JP); Yutaka Saeki, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 305 days.

This patent is subject to a terminal disclaimer.

(21) Appl. No.: 11/038,163

(22) Filed: Jan. 21, 2005

(65) Prior Publication Data

US 2005/0156836 A1 Jul. 21, 2005

(30) Foreign Application Priority Data

Jan. 21, 2004 (JP) ..... 2004-013464

(51) Int. Cl.
*G09G 3/10* (2006.01)

(52) U.S. Cl. ..... 315/169.1; 345/76; 345/77; 345/204

(58) Field of Classification Search ... 315/169.1–169.3; 345/76–78, 102, 211–212, 690, 692, 693, 345/82, 204
See application file for complete search history.

(56) References Cited

U.S. PATENT DOCUMENTS 4,408,190 A * 10/1983 Nagano ..... 341/135
4,996,523 A 2/1991 Bell et al. ..... 315/169.3
6,747,417 B2 * 6/2004 Meade et al. ..... 315/169.3
6,756,738 B2 * 6/2004 Maede et al. ..... 315/169.1
6,774,882 B2 * 8/2004 Yamazaki et al. ..... 345/98
7,015,647 B2 * 3/2006 Maede et al. ..... 315/169.3
7,030,841 B2 * 4/2006 Abe et al. ..... 345/76
2003/0058199 A1 * 3/2003 Kasai ..... 345/76
2005/0156635 A1 * 7/2005 Yoneyama et al. ..... 327/108

FOREIGN PATENT DOCUMENTS

JP 2-148687 6/1990

* cited by examiner

*Primary Examiner*—Douglas W. Owens
*Assistant Examiner*—Jimmy T Vu
(74) *Attorney, Agent, or Firm*—McGinn IP Law Group, PLLC

(57) ABSTRACT

Disclosed is a display driver that includes a first current driver circuit, a second current driver circuit and a reference current source circuit. The first current driver circuit, which has plural current sources the output current values of which are determined based on a reference current, and switch circuits for on/off controlling the current path between the plural current sources and the current output terminal based on video signal composed of plural bits. The first current driver circuit outputs a first output current conforming to the video signal. The second current driver circuit outputs the second output current conforming to the video signal, while the reference current source circuit variably controls the reference current based on the value of the video signal. A current that is the result of combining the first and second output currents from the first and second current driver circuits is output as an output current. An amount of change in the output current that corresponds to a change of one LSB of the video signal, is varied in accordance with the value of the video signal, the gamma characteristic is approximated by piece-wise linear approximation and the overall luminance of the display pane is variably controlled based on a control signal from a panel luminance adjustment circuit.

31 Claims, 27 Drawing Sheets

FIG . 9

| VIDEO SIGNAL | INTERVAL | Dcon a1 | Dcon a2 | Dcon a3 | Dcon a4 |
|---|---|---|---|---|---|
| 0 | 1 | 1 | 0 | 0 | 0 |
| • • • | | 1 | 0 | 0 | 0 |
| 15 | | 1 | 0 | 0 | 0 |
| 16 | 2 | 0 | 1 | 0 | 0 |
| • • • | | 0 | 1 | 0 | 0 |
| 31 | | 0 | 1 | 0 | 0 |
| 32 | 3 | 0 | 0 | 1 | 0 |
| • • • | | 0 | 0 | 1 | 0 |
| 47 | | 0 | 0 | 1 | 0 |
| 48 | 4 | 0 | 0 | 0 | 1 |
| • • • | | 0 | 0 | 0 | 1 |
| 63 | | 0 | 0 | 0 | 1 |

FIG . 13

| VIDEO SIGNAL | INTERVAL | $D_{con}b1$ | $SW_{con}b1$ | $SW_{con}b2$ | $SW_{con}b3$ | $SW_{con}b4$ |
|---|---|---|---|---|---|---|
| 0 | 1 | VRCONH1 | 1 | 0 | 0 | 0 |
| • • • | | | 1 | 0 | 0 | 0 |
| 15 | | | 1 | 0 | 0 | 0 |
| 16 | 2 | (VRCONH1 × (b2+b3) +b1 × VRCONL1) /A<br>A= (b1+b2+b3) | 0 | 1 | 0 | 0 |
| • • • | | | 0 | 1 | 0 | 0 |
| 31 | | | 0 | 1 | 0 | 0 |
| 32 | 3 | (VRCONH1 × b3+VRCONL1 × (b1+b2)) /A<br>A= (b1+b2+b3) | 0 | 0 | 1 | 0 |
| • • • | | | 0 | 0 | 1 | 0 |
| 47 | | | 0 | 0 | 1 | 0 |
| 48 | 4 | VRCONL1 | 0 | 0 | 0 | 1 |
| • • • | | | 0 | 0 | 0 | 1 |
| 63 | | | 0 | 0 | 0 | 1 |

FIG . 16

| VIDEO SIGNAL | INTERVAL | Dadd1 | Dadd2 | Dadd3 | $I_{OUT2}$ |
|---|---|---|---|---|---|
| 0 | 1 | 0 | 0 | 0 | 0 |
| • • • | | 0 | 0 | 0 | |
| 16 | 2 | 1 | 0 | 0 | $I_{Add1}$ |
| 17 | | 1 | 0 | 0 | |
| • • • | | 1 | 0 | 0 | |
| 32 | 3 | 0 | 1 | 0 | $I_{Add2}$ |
| 33 | | 0 | 1 | 0 | |
| • • • | | 0 | 1 | 0 | |
| 48 | 4 | 0 | 0 | 1 | $I_{Add3}$ |
| 49 | | 0 | 0 | 1 | |
| • • • | | 0 | 0 | 1 | |
| 63 | | 0 | 0 | 1 | |

FIG . 21

| VIDEO SIGNAL | INTERVAL | $D_{Add}b1$ | $SW_{Add\ b1}$ | $SW_{Add\ b2}$ | $SW_{Add\ b3}$ | $SW_{Add\ b4}$ |
|---|---|---|---|---|---|---|
| 0 | 1 | VRCONH2 | 1 | 0 | 0 | 0 |
| • • • | | | 1 | 0 | 0 | 0 |
| 15 | | | 1 | 0 | 0 | 0 |
| 16 | 2 | (VRCONH2 × (c2+c3)+c1 × VRCONL2) /B<br>B=(c1+c2+c3) | 0 | 1 | 0 | 0 |
| • • • | | | 0 | 1 | 0 | 0 |
| 31 | | | 0 | 1 | 0 | 0 |
| 32 | 3 | (VRCONH2 × c3+VRCONL2 × (c1+c2)) /B<br>B=(c1+c2+c3) | 0 | 0 | 1 | 0 |
| • • • | | | 0 | 0 | 1 | 0 |
| 47 | | | 0 | 0 | 1 | 0 |
| 48 | 4 | VRCONL2 | 0 | 0 | 0 | 1 |
| • • • | | | 0 | 0 | 0 | 1 |
| 63 | | | 0 | 0 | 0 | 1 |

DRIVER CIRCUIT FOR LIGHT EMITTING ELEMENT

FIELD OF THE INVENTION

This invention relates to a driver circuit for a light-emitting element and to a display device. More particularly, the invention relates to a driver circuit and device that perform a gamma correction.

BACKGROUND OF THE INVENTION

An arrangement of the kind illustrated in FIG. 25 by way of example is known as an electroluminescent storage device (refer to the specification of Japanese Patent Kokai Publication No. JP-A-2-14868 pages 5 and 6, FIG. 2). As shown in FIG. 25, this conventional electroluminescent device includes an electroluminescent element 40; a plurality of memory cells 22 corresponding to the electroluminescent element 40; a current source 28 (a current mirror comprising transistors 26 and 27); current control means (transistors) 24, which correspond to the plurality of memory cells 22, connected to corresponding ones of the memory cells 22 and responsive to signals, which are held in the memory cells 22, for controlling current that flows from the current source 28 to the electroluminescent element 40; and control logic, a column data register, display input/readout logic and row strobe register, etc., none of which are shown, for supplying the memory cells 22 with signals Bn to B0 representing luminance required by the electroluminescent element 40.

Current corresponding to the signals held in the memory cells 22 flows through transistors 24*n* to 24*n*-3, current that is the sum of the currents that flow through the transistors 24*n* to 24*n*-3 enters the drain of the transistor 26 constituting the input end of the current source (current mirror) 28, and the mirror current of the input current is output from the drain of the transistor 27, which constitutes the output end of the current source (current mirror), and is supplied to the electroluminescent element 40.

In the arrangement shown in FIG. 25, the relationship between the input data signal and the output current (and therefore luminance) is a positive proportional relationship (gamma value=1.0). Consequently, in order to perform a correction such as one where the gamma value is 2.2, the gamma correction must be applied to the video signal stored in the memory cells 22. Since the human eye is sensitive to dark colors, an image will appear more natural if the luminance of the input signal satisfies a luminance=(signal strength) (e.g., $\gamma$=1.8, 2.2, etc.) relationship rather than a positive proportional relationship. In general, therefore, the relationship between panel luminance and the video signal is provided with a gamma characteristic.

Generally, in a case where a gamma correction is made, as shown in FIG. 26, a gamma correction circuit 131 for making the relationship between the input signal (video signal) and luminance conform to the gamma characteristic is provided on the input side of a display element driver circuit 132. The signal that has been gamma-corrected by the gamma correction circuit 131 is input to the display element driver circuit 132, and the data signal is supplied from the display element driver circuit 132 to a display element panel 133 via a data signal line. Since the gamma correction circuit 131 is necessary in this arrangement, however, not only is the circuitry large in size but an additional problem is a reduction of grayscales that can be expressed. For example, if the gamma characteristic (gamma value=2.2) is expressed using an 8-bit (256 grayscales) display element driver circuit 132, only 187 grayscales can be realized.

In order to implement a gamma correction having grayscale (256 grayscales) the same as those of the input signal, on the other hand, it is necessary that the gamma correction circuit 131 and display element driver circuit 132 be capable of supporting more grayscales than those of the input signal, as illustrated in FIG. 27. Consequently, the circuitry is large in size. In the example illustrating in FIG. 27, both the gamma correction circuit 131 and display element driver circuit 132 support 512 grayscales (nine bits).

[Patent Document 1]

Japanese Patent Kokai Publication No. JP-A-2-148687, pages 5 and 6, FIG. 2)

Thus, in a case where the conventional display circuit is provided with a gamma correction function, a problem which arises is the large size of the circuitry, as mentioned above. The same is true also in a case where a gamma correction of grayscales identical with those of the input signal is performed.

SUMMARY OF THE DISCLOSURE

Accordingly, it is an object of the present invention to provide a driver circuit that makes it possible to reduce the size of circuitry and diminish chip area in realizing a gamma characteristic, as well as to a display device having this driver circuit.

Another object of the present invention is to provide a driver circuit that makes it possible to adjust the overall luminance of a display panel while maintaining the gamma characteristic, as well as a display device having this driver circuit.

The above and other objects are attained by the present invention, which enables optimum display by varying the reference current, flowing through a reference current source circuit, based on a video signal, for approximating the input/output characteristic of the EL element driver circuit to e.g. the gamma characteristic. More specifically, the reference current prescribes the amount of change in the output current corresponding to a unit change of the input signal A driver circuit in accordance with one aspect of the present invention, includes a reference current source circuit for varying the value of the reference current based on the input signal; and an output current generating circuit for generating the output current conforming to the input signal based on the reference signal to output the output current at the output terminal, wherein a characteristic between the input signal that is input to an input terminal and the output current that is output from the output terminal is made a predetermined input/output characteristic of a prescribed non-linearity.

In the present invention, the input signal is a digital signal, and a unit change of the input signal corresponds to a one bit equivalent which is the least significant bit (LSB) of the digital signal.

In the present invention, the input signal is a digital signal, and the output current generating circuit includes a first current generating circuit for generating a first output current corresponding to the input signal based on the reference current source, and a second current generating circuit for generating a second output current corresponding to the input signal from a current source distinct from the reference current source. A current, that is the result of combining (adding or subtracting) the first output current and the second output current is output as the output current from the output terminal.

A range of the input signal from a minimum value to a maximum value is divided into plural intervals, and the first output current is zero at one end of one such interval, with the second output current being the aforementioned output current output from the output terminal.

According to the present invention, the current value of the output current at least one of the leading end and the trailing end of said interval of the input signal is set to a current value corresponding to a theoretical (ideal) value of an input/output characteristic of predetermined non-linearity and linear approximation of the non-linear input/output characteristic is performed from one interval to the next.

In another aspect, the present invention provides a driver circuit for a light-emitting element in which a light emitting element, having light emission controlled responsive to the current supplied, receives a video signal input via an input terminal, to generate the current corresponding to the video signal, to output the current thus generated at an output terminal, in which the driver circuit for a light-emitting element comprises a decoder supplied with the video signal composed of plural bits to decode the video signal thus supplied, a first current driver circuit including a plurality of current sources, the current value in each of which is prescribed based on the value of a given reference current, and a switch circuit for on/off control of a current path between the plural current sources and a current output terminal, based on an output signal of the decoder, to output a first output current conforming to the value of the video signal. The driver circuit for a light-emitting element also comprises a second current driver circuit outputting a second output current conforming to the value of the video signal, and a reference current source circuit having a reference current source outputting the reference current, with the reference current source circuit variably controlling the reference current output based on the value of the video signal. A current that is the result of combining the first and second output currents from the first and second current source circuits is output at the output terminal as an output current, and the amount of change in the output current corresponding to a change in a unit quantity of the video signal is varied responsive to the video signal.

In another aspect, the present invention provides a driver circuit for a light-emitting element in which a luminance adjustment signal is used to control the current source to adjust the luminance of the light emitting element. More specifically, the present invention preferably includes a luminance adjustment circuit for variably generating the control voltage based on an input control signal. The output current value of the output reference current, output by the reference current source circuit, is changed based on the control voltage. According to the present invention, the second current driver circuit varies the current value of the output current based on the control voltage.

According to the present invention, the second current driver circuit includes a multi-output current mirror circuit supplied with the reference current at an input end for outputting the output current, which is a turned versions of the reference current, from plural outputs thereof, and a plurality of switch elements receiving signals obtained on decoding the video signal by the decoder at control terminals thereof, with the switch elements having one ends connected to the plural output ends of the current mirror circuit and having the other ends connected in common to the current output ends.

According to the present invention, the reference current source circuit includes a plurality of current sources having one ends connected in common to a first potential, a decoder for the reference current source circuit, supplied with and decoding the video signal to output decoded results, and a plurality of switch elements having one ends connected to output ends of the plural current sources and having the other ends connected in common to a reference current output ends outputting the reference current. The switch elements are controlled on or off based on a signal output from the decoder for the reference current source circuit.

According to the present invention, the reference current source circuit includes one or more current sources having one end connected to a first potential and having each output end connected to a current output end outputting the reference current, a decoder for the reference current source circuit, supplied with and decoding the video signal to output decoded results, and a voltage selection circuit supplying a bias current to the one or more current sources, based on decoded results by the decoder for the reference current source circuit. The current source(s) vary the output current of the current source(s) responsive to the bias current.

According to the present invention, the second current driver circuit includes a decoder for the second current driver circuit supplied with and decoding the video signal to output decoded results, a first set of current sources, having one ends connected in common to a first potential, and a first set of switch devices having one ends connected to output ends of the current sources of the first set and having the opposite ends connected in common to the current output end. The switch devices of the first set, receiving a signal of the decoder for the second current driver circuit at control terminals thereof, are thereby turned on or off.

According to the present invention, the second current driver circuit includes a second set of current sources, having one ends connected in common to a second potential, and a second set of switch devices having one ends connected to output ends of the current sources of the second set and having the opposite ends connected in common to the current output end. The switch devices of the second set, receiving a signal of the decoder for the second current driver circuit at control terminals thereof, are thereby turned on or off.

According to the present invention, the second current driver circuit includes a decoder for the second current driver circuit supplied with and decoding the video signal to output decoded results, one or more current sources having one end(s) connected to a first potential and having output end(s) connected to a current output end outputting the second output current, and a voltage selection circuit for supplying a bias voltage to the one or more current source(s), based on the decoded results by the decoder for the second current driver circuit. The current source(s) vary an output current from the output end of the current source(s) responsive to the bias voltage.

According to the present invention, the control voltage, output from the luminance adjustment circuit, is supplied as the first potential and/or the second potential of the second current driver circuit.

The meritorious effects of the present invention are summarized as follows.

According to the present invention, it is possible to reduce the circuit scale of the driver circuit for a light-emitting element having a gamma characteristic and to reduce the chip area.

In accordance with the present invention, the overall luminance of a panel can be adjusted while maintaining the gamma characteristic.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

FIG. 9 illustrates the operation of the reference current supply circuit in the embodiment of the present invention.

FIG. 13 illustrates the operation of the voltage selection circuit of FIG. 12.

FIG. 16 illustrates the operation of the current driver circuit of FIG. 15.

FIG. 21 illustrates the operation of the second current driver circuit shown in FIG. 20.

PREFERRED EMBODIMENTS OF THE INVENTION

The present invention will be described below with reference to the accompanying drawings.

Figure 24:
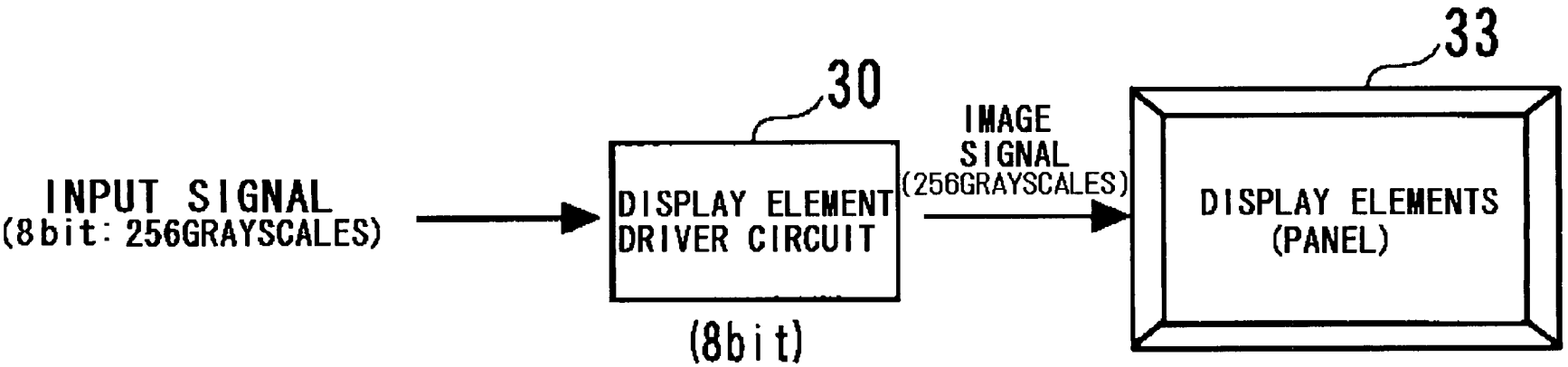
FIG. 24 is a diagram illustrating a configuration of a display device of the present invention.
Figure 25:
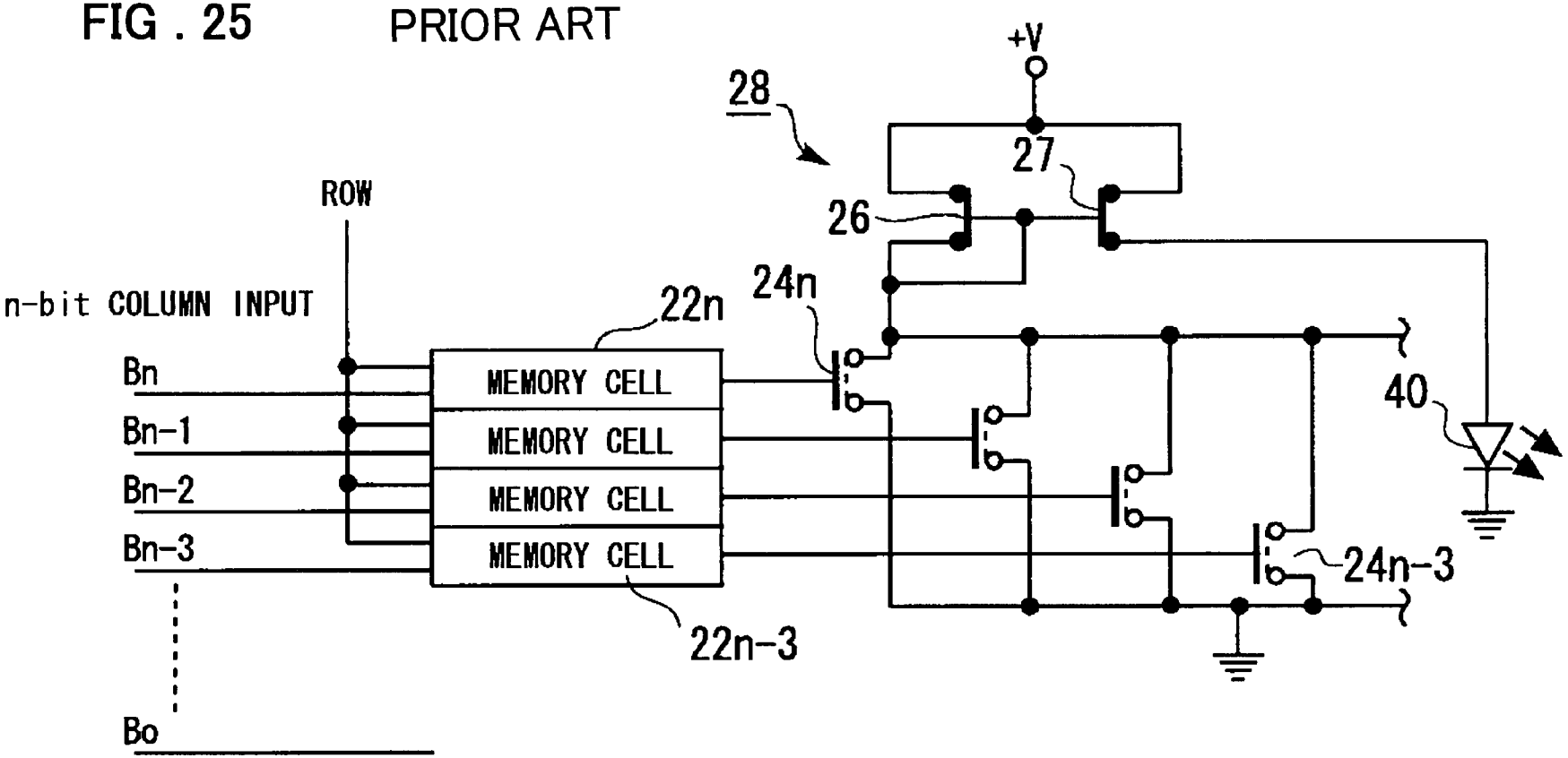
FIG. 25 PRIOR ART
FIG. 25 is a diagram illustrating a configuration of a conventional EL storage display device.
Figure 26:
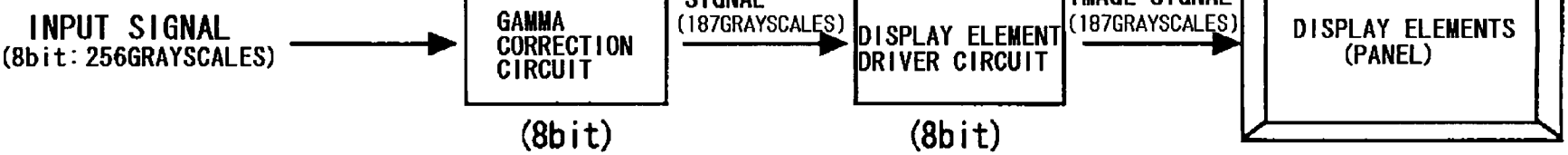
FIG. 26 PRIOR ART
FIG. 26 is a diagram illustrating a configuration of a display device having the gamma correcting function.
Figure 27:
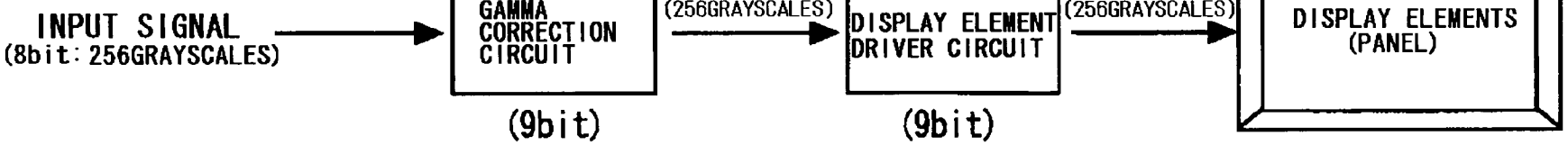
FIG. 27 PRIOR ART
FIG. 27 is a diagram illustrating another configuration of a display device having the gamma correcting function.

The overall structure of a display device according to an embodiment of the present invention will be described with reference to FIG. 24. The display device incorporates a gamma correction function in a display-element driver circuit 130 to which an input signal (video signal) is applied for driving current through a display element of a display panel. By virtue of this structure, the area of the circuitry and area of the chip when the device is integrated can be reduced in comparison with the conventional structure shown in FIGS. 26 and 27. A further characterizing feature is that the display-element driver circuit 130 supports 256 grayscale levels (represented by eight bits) and is capable of delivering a 256 grayscale input signal to a display element (panel) 133. A gamma correction circuit supporting 512 grayscale levels (represented by nine bits) and a display-element driver circuit supporting nine bits, which are employed in the arrangement of FIG. 27, are unnecessary.

Figure 1:
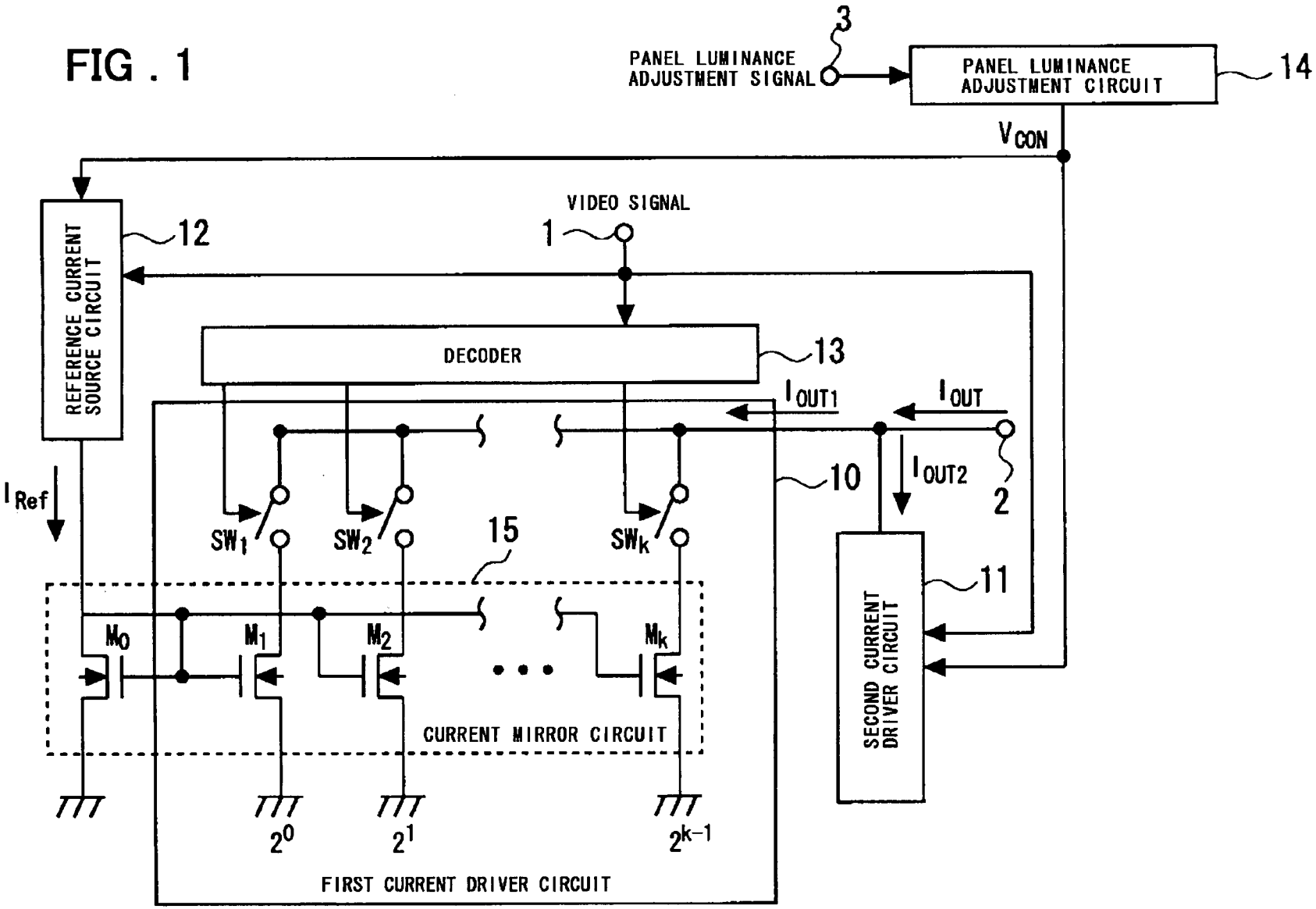
FIG. 1 is a diagram illustrating the configuration of a driver circuit for a light-emitting element according to an embodiment of the present invention.

As illustrated in FIG. 1, a driver for a display device according to the present invention comprises: a first current driver circuit 10, which has a plural number of current sources ($M_0$ and $M_1$ to $M_k$) for outputting current of a value decided based upon a preset reference current ($I_{REF}$), and switch circuits($SW_1$ to $SW_k$) for on/off controlling current paths between the plurality of current sources ($M_1$ to $M_k$) and a current output terminal (2), based upon a vide signal to send out a first output current ($I_{OUT1}$) corresponding to the value of the video signal (grayscale); a second current driver circuit 11 for outputting a second output current ($I_{OUT2}$) conforming to video signal (grayscale, interval), and a reference current source circuit 12, which has a current source that generates the reference current ($I_{REF}$), for variably controlling the reference current ($I_{REF}$) based on the value of video signal (grayscale, interval). A current that is the result of combining the first output current ($I_{OUT1}$) from the first current driver circuit and the second output current ($I_{OUT2}$) from the second current driver circuit 11 is output from the output terminal 2 as an output current ($I_{OUT}$). An amount of change in the output current ($I_{OUT}$) that corresponds to a change in unit value of the video signal is varied in accordance with the value of the video signal, and the input/output characteristic of output current with respect to the video signal has a desired characteristic.

In an embodiment of the present invention, by changing the reference current ($I_{REF}$), which is for outputting a driving current conforming to the video signal, in accordance with the value of the video signal (grayscale), the increment (amount of change in units of the LSB) in output current of the driver circuit is varied, whereby a gamma characteristic having a gamma value of 2.2 or the like can be approximated with a piece-wise linear approximation method. In addition, the overall luminance of the display panel can be varied by varying the reference current ($I_{REF}$) and/or second output current based upon an applied panel-luminance adjustment signal.

The present invention will now be described in greater detail with reference to the drawings illustrating a preferred embodiment to which the invention is applied.

FIG. 1 shows a circuit configuration of a driver circuit for a light-emitting element according to an embodiment of the present invention. Meanwhile, the driver circuit for a light-emitting element, described in the following first embodiment, is a sink-current type current driver circuit for supplying the output current $I_{OUT}$ (sink current) to the light emitting elements of the display panel. It is assumed that, in the embodiment, now explained, the luminance of the light emitting elements, such as EL elements, is proportional to the current value of the driving current supplied to the light emitting elements.

Referring to FIG. 1, the driver circuit for a light-emitting element of the present embodiment includes: a first current driver circuit 10 for generating and outputting the driving current corresponding to the value (grayscale) of video signal, made up of digital signal, a second current driver circuit 11 for generating and outputting the driver circuit corresponding to the value (grayscale) of video signal, a reference current source circuit 12, a panel luminance adjustment circuit 14, and a decoder 13 for decoding the video signal and sending the decoded result to the first current driver circuit 10. In the case of $2^k$ grayscales, where k is a preset positive integer not less than 2, the video signal is k-bit signal.

The reference current source circuit 12, which receives the video signal and a control voltage $V_{CON}$ output from the panel luminance adjustment circuit 14, generates and outputs a reference current $I_{Ref}$ corresponding to the input video signal. The reference current $I_{Ref}$, output from the reference current source circuit 12, may also be varied by the $V_{CON}$.

The first current driver circuit 10, which receives the reference current ($I_{REF}$) and an output signal from the decoder 13, turns on/off the current paths between the plural current sources $M_1$ to $M_k$ and the output terminal 12, by a plural number (k) of switches $SW_1$ to $SW_k$, which are on/off controlled based on the output signal from the decoder 13, supplied with digital video signal from the input terminal 1, to output a first output current $I_{OUT1}$ corresponding to the lower bits of the video signal. For example, if the video signal is "zero", the switches $SW_1$ to $SW_k$ are all off, such that the first output current ($I_{OUT1}$) is 0.

The second current driver circuit 11 which receives the video signal and a control voltage $V_{CON}$ output from the panel luminance adjustment circuit 14 to output a second output signal $I_{OUT2}$ that is varied in accordance with the video signal and the control voltage $V_{CON}$. It is noted that the second current driver circuit 11 is also provided with a decoder for decoding video signal, switches, and with a plural number of current sources, as will be explained subsequently.

A current that is the result of combining the first output current ($I_{OUT1}$) from the first current driver circuit 10 and the second output current ($I_{OUT2}$) from the second current driver circuit 11 (sum current) is output from the output terminal 12 to a data line, not shown, as an output current $I_{OUT}$ for driving light emitting elements, such as EL elements, not shown, from the output terminal 12.

In the present embodiment, the reference current $I_{REF}$, output from the reference current source circuit 12, prescribes the amount of change in the output current when the digital video signal is changed by one LSB (least significant bit). In the reference current source circuit 12, the reference current $I_{REF}$ is variably controlled by the video signal and by the control voltage $V_{CON}$ from the panel luminance adjustment circuit 14. This configuration represents a feature of the present invention. In case the current value of the reference current $I_{REF}$ is large or small, the amount of change in the output current $I_{OUT}$ (quantization step) in case the video signal has been changed by one LSB is large or small, respectively.

Referring to FIG. 1, the configuration of the first current driver circuit 10 is explained in further detail. The first current driver circuit includes k switches $SW_1$ to $SW_k$, having one ends connected in common to the output terminal 2 and having control terminals supplied with decoded result signals from the decoder 13 so as to be thereby turned on or off. The other ends of the k switches $SW_1$ to $SW_k$ are connected to drains of NMOS transistors $M_1$ to $M_k$ respectively. An NMOS transistor $M_0$, having a source grounded, and having a drain and a gate coupled to each other and to an output end of the reference current source circuit 12, on one hand, and NMOS transistors $M_1$ to $M_k$, having sources grounded and having gates connected in common to the connection node of the gate and the drain of the NMOS transistor $M_0$, on the other hand, form a multi-output current mirror circuit. The reference current $I_{Ref}$ is input to an input side transistor $M_0$ of a multi-output current mirror $M_0$ to $M_k$. The mirror current is output from each of the current sources $M_1$ to $M_k$ of the first current driver circuit 10. The W/L ratio (gate width/ gate length ratio, also termed the 'aspect ratio') of the NMOS transistors $M_1$ to $M_k$ is set so as to be $2^0, 2^1, \ldots, 2^{(k-1)}$ times the W/L ratio of the of the NMOS transistor $M_0$, with the current driving capability of the transistors also being $2^0, 2^1, \ldots, 2^{(k-1)}$ times in keeping with the W/L ratio. From the drains of the NMOS transistors $M_1$ to $M_k$, having the associated switches turned on, the currents weighted to $2^0$ (=1), $2^1$(=2), . . . , $2^{(k-1)}$ times the drain current of the NMOS transistor $M_0$ (sink currents) are output as mirror currents, respectively.

The output current ($I_{OUT1}$) from the first current driver circuit 10 can be made to correspond to the currents of $2^k$ grayscales (video signal is of k bits). Alternatively, the video signal may be divided into plural intervals from the smallest value up to the largest value and variable control may be exercised for each of the interval. For example, if, in the driver circuit for a light-emitting element of 64 grayscales, with the video signal being 6 bits, the maximum amplitude of the video signal (64 grayscales) is divided with equal range into four intervals, and an output signal at an end of each interval is made coincident with the gamma characteristic, by way of piece-wise linear approximation, control of the current of 64 grayscales/four intervals=16 grayscales (four bits), that is, lower four bits, is taken charge of by the first current driver circuit 10. It is noted that, if the number of grayscales, taken charge of by the first current driver circuit 10, is a power of 2 ($2^1$), the decoder 13 of FIG. 1 is unneeded, such that lower bits (i bits) of the binary video signal, entered from the input terminal 1, are supplied to the control terminals switches $SW_1$ to $SW_i$, respectively.

If the number of grayscales, taken charge of by the first current driver circuit 10, differs from the power of 2, the video signal needs to be decoded by the decoder 13 to control the switches $SW_1$ to $SW_k$ on or off, using the decoder 13. If the W/L ratio of the NMOS transistors $M_1$ to $M_k$ is of the same value, that is, no weighting is applied, lower bit signals of the binary video signal need to be decoded by the decoder 13 to control the switches $SW_1$ to $SW_k$ on or off. That is, $2^i$ NMOS transistor current sources $SW_1$ to $SW_2{}^i$ may be provided in the first current driver circuit 10 in association with lower i bits of the video signal, and $2^i$ switches SW1 to SW2$^i$ may be provided in keeping with $2^i$ current sources, with the decoder 13 then decoding lower i bits of the video signal to perform on/off control of the switches $SW_1$ to SW2$^i$ for connecting a number of the current sources corresponding to the value of the lower i bits of the video signal to the output terminal 2.

The second current driver circuit 11 outputs the second output current ($I_{OUT2}$) of the driver circuit for a light-emitting element in association with video signal ($2^k$ grayscales). The output current $I_{OUT}$ from the output terminal 2 is the current sum of the first output current $I_{OUT1}$ from the first current driver circuit 10 and the second output current $I_{OUT2}$ from the second current driver circuit 11. That is, with the present embodiment, the desired output current $I_{OUT}$ may be obtained on combining the output current $I_{OUT1}$ of the first current driver circuit 10 to the second output current $I_{OUT2}$ from the second current driver circuit 11, thereby realizing optimum piece-wise linear approximation of the output current $I_{OUT}$ from the output terminal 2 to the gamma characteristics. The gamut from the minimum value (e.g. zero grayscale) to the maximum value (e.g. $2^k$ grayscales) of the video signal may be divided into plural intervals, with the first output current $I_{OUT1}$ being zero at one end of a interval, with the second output current $I_{OUT2}$ being the output current $I_{OUT}$.

A panel luminance adjustment signal, fed to the panel luminance adjustment circuit 14, is used for varying the reference current $I_{REF}$ and the current value of the second current driver circuit 11 to perform adjustment control to cause light emitting elements, not shown, to emit light at an optimum luminance. In the example shown in FIG. 1, an output current $I_{OUT}$ from the output terminal 2 is output as a sink current, however, it may, of course, be designed as a source current. In the latter case, the current mirror circuit 15, forming the current source of the first current driver circuit 10, is formed by a PMOS transistor (PMOS current source) instead of by an NMOS transistor, the current source of the second current driver circuit 11 is formed by a PMOS current source, and the current source of the reference current source circuit 12 is formed by an NMOS current source.

Figure 2:
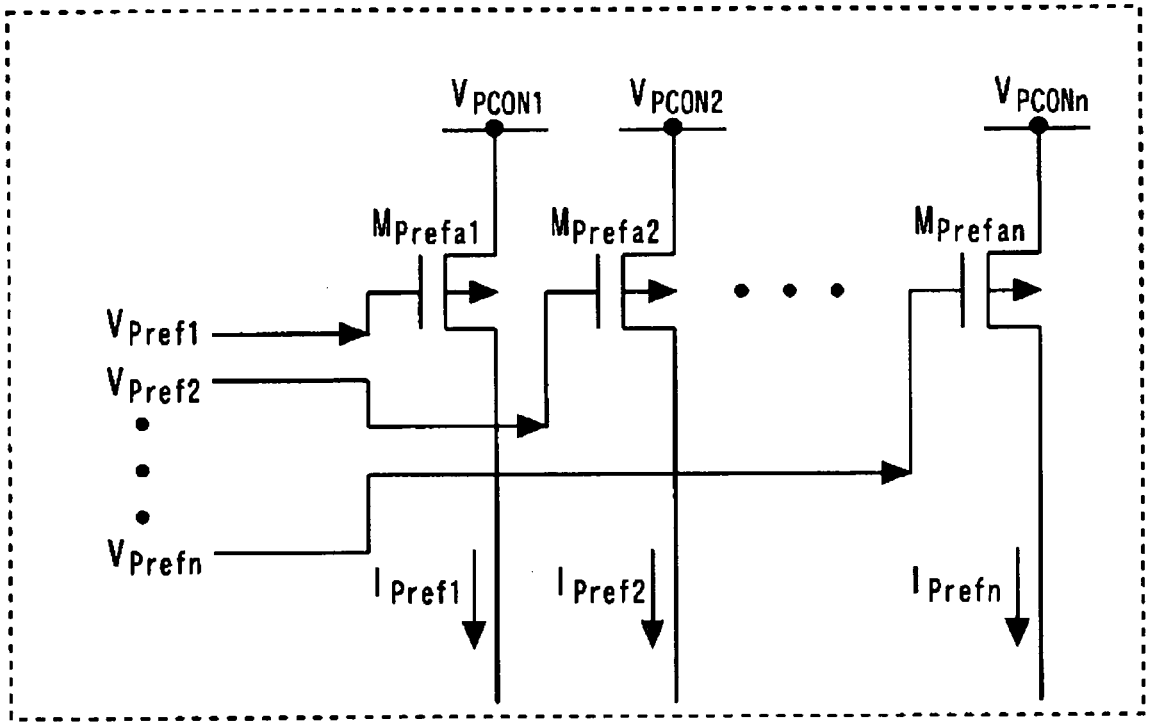
FIG. 2 is a diagram illustrating an example of the configuration of a PMOS power supply used in the embodiment of the present invention.
Figure 3:
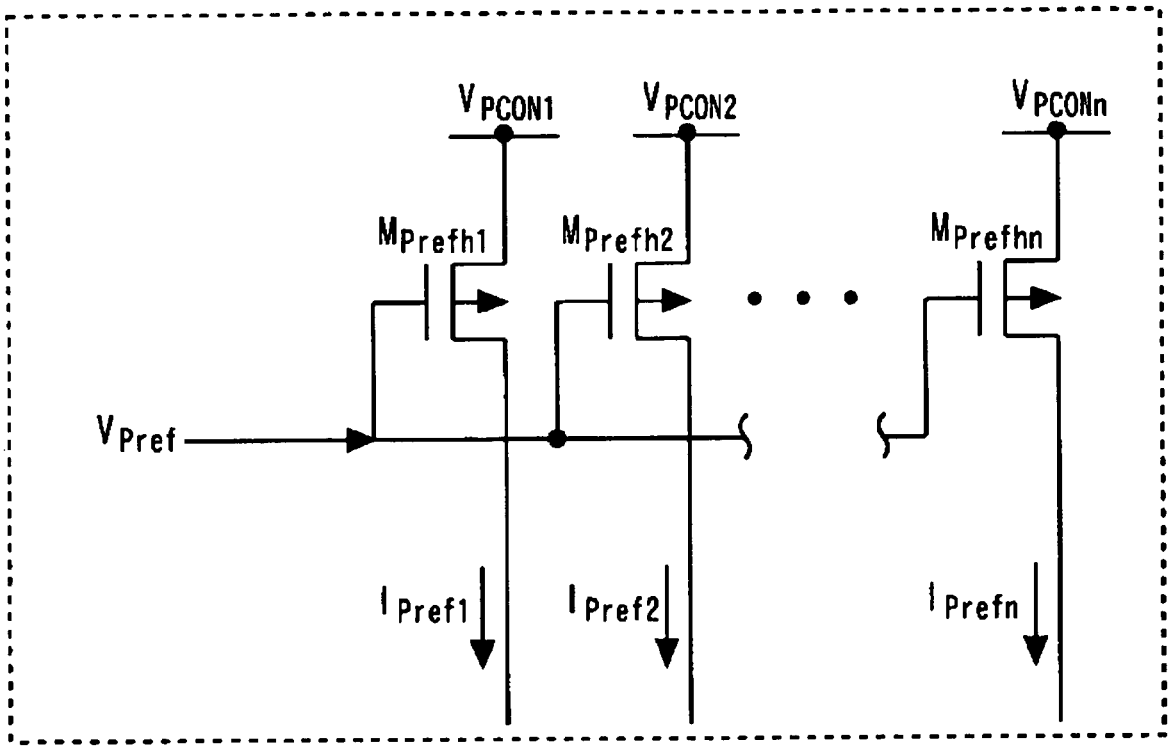
FIG. 3 is a diagram illustrating another example of the configuration of a PMOS power supply used in the embodiment of the present invention.
Figure 4:
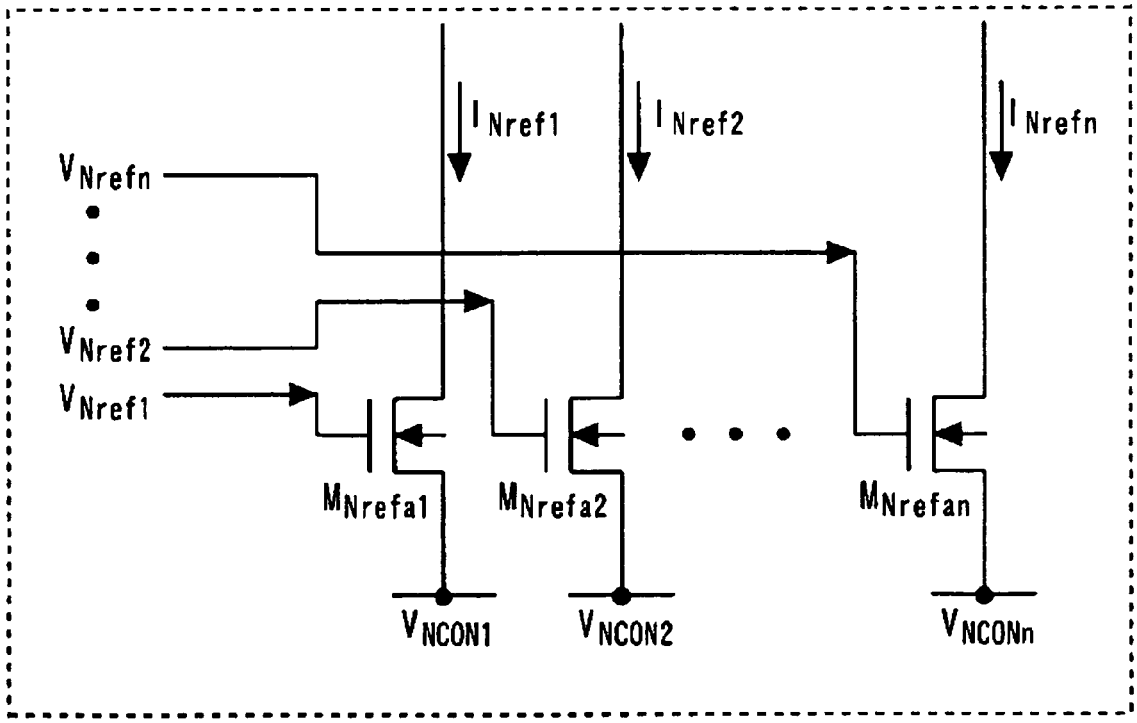
FIG. 4 is a diagram illustrating of the configuration of an NMOS power supply used in the embodiment of the present invention.
Figure 5:
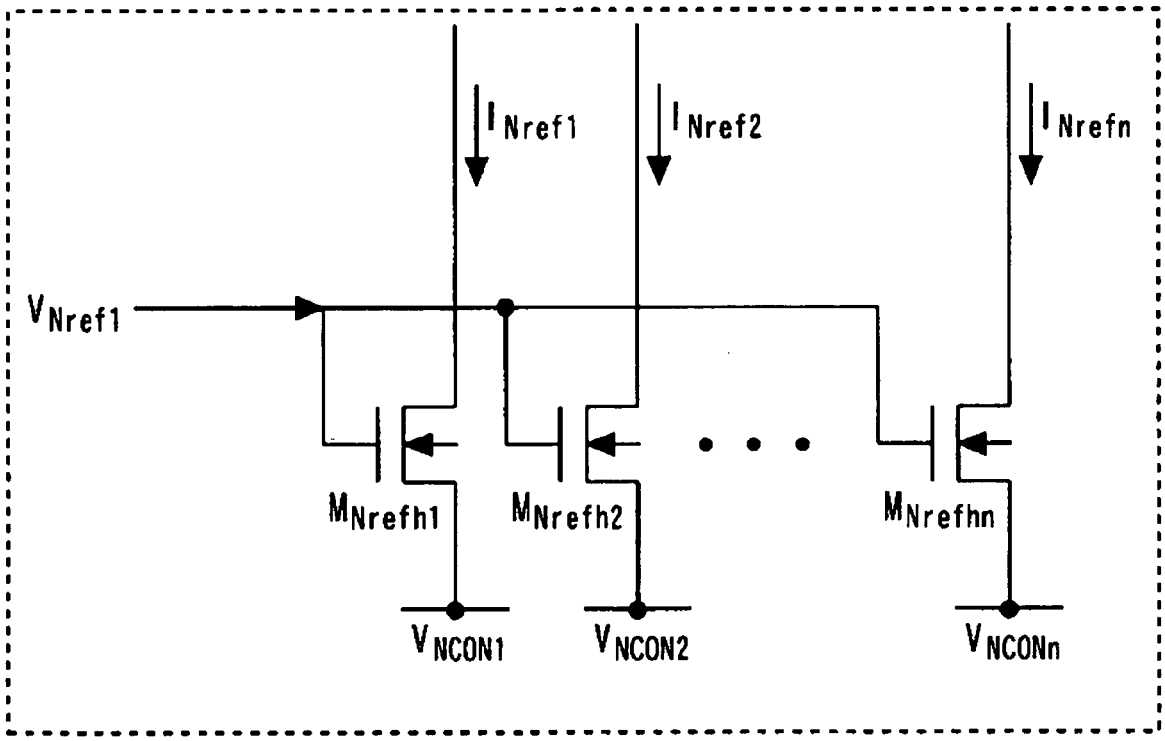
FIG. 5 is a diagram illustrating another example of the configuration of an NMOS power supply used in the embodiment of the present invention.

FIGS. 2 and 3 show an example of a current source composing the reference current source circuit 12 shown in FIG. 1 (source current outputting current source). The current source in the present embodiment is formed by a PMOS transistor (also termed a PMOS current source). FIGS. 4 and 5 show an embodiment in which the current source is formed by an NMOS transistor (also termed an NMOS current source). In the present embodiment, the PMOS current source and the NMOS current source are associated with the configuration shown in FIGS. 2 and 3 and with the configuration shown in FIGS. 4 and 5, respectively.

In the circuit configuration, shown in FIG. 2, different bias voltages are applied to the gates of plural transistors forming plural current sources outputting different current values. In the circuit configuration, shown in FIG. 3, a constant bias is applied to the gates of plural transistors, forming plural current sources outputting different currents, while the W/L ratio of the transistors is different from one transistor to another to yield different output currents.

More specifically, in FIG. 2, gate voltages (bias voltages) $V_{Pref1}$ to $V_{Prefn}$ of transistors $M_{Prefa1}$ to $M_{Prefan}$, making up the PMOS current sources, are controlled to vary currents $I_{Pref1}$ to $I_{Prefn}$ flowing through the respective current source transistors. The configuration shown in FIG. 4 is the same as that of FIG. 2 except for the difference in polarity (the transistors used being NMOS transistors). In the configuration shown in FIG. 3, the common gate voltage $V_{Pref}$ of transistors $M_{Prefh1}$ to $M_{Prefhn}$, making up the PMOS current sources, is used, and the W/L ratio of the transistors $M_{Prefh1}$ to $M_{Prefhn}$ is adjusted to vary the currents $I_{pref1}$ to $I_{Prefn}$ flowing through the transistors $M_{Prefh1}$ to $M_{Prefhn}$. The configuration shown in FIG. 5 is similar in this respect.

In FIGS. 2 and 3, the currents $I_{Pref1}$ to $I_{Prefn}$ flowing through the plural transistors (current sources) may be varied by varying the source potentials $V_{PCON1}$ to $V_{NCONn}$ of the PMOS transistors.

In FIGS. 4 and 5, the currents $I_{Nref1}$ to $I_{Nrefn}$ flowing through the plural transistors (current sources) may be varied by varying the source potentials $V_{NCON1}$ to $V_{NCONn}$ of the NMOS transistors.

The source potential $V_{PCON}$ of the PMOS current source of FIGS. 2 and 3 and the source potential $V_{NCON}$ of the NMOS current sources of FIGS. 4 and 5 correspond to the control voltage $V_{CON}$ output from the panel luminance adjustment circuit 14 (see FIG. 1). The luminance of the light emitting elements is varied in proportion to the current flowing through the light emitting elements. Hence, the luminance of the display panel in its entirety may be adjusted by controlling the voltages of the control voltages $V_{PCON}$ and $V_{NCON}$.

The PMOS current sources, shown for example in FIGS. 2 and 3, are used as a current source of the reference current source circuit 12 of FIG. 1, the current sources $I_{Pref1}$ to $I_{Prefn}$ are selected with a switch, based on the video signal, and the current of the selected current source is output as the reference current $I_{Ref}$. The NMOS current sources, shown for example in FIGS. 4 and 5, are used as a current source of the second current driving source 11 of FIG. 1, the current sources $I_{Nref1}$ to $I_{Nrefn}$ are selected with a switch, based on the video signal, and the current of the selected current source is output as the reference current $I_{OUT2}$. Specified examples of the configuration of the second current driver circuit 11 and the reference current source circuit 12 will be explained later in detail.

For the 64-grayscale driver circuit for a light-emitting element, current control of the driver circuit for a light-emitting element, in case the 64 grayscales are equally divided into four interval, is now explained. In the following example, it is assumed that, for the gamma value=2.2 and for the video signal of 64 grayscales, the driver circuit for a light-emitting element outputs the current of 64 μA.

Figure 6:
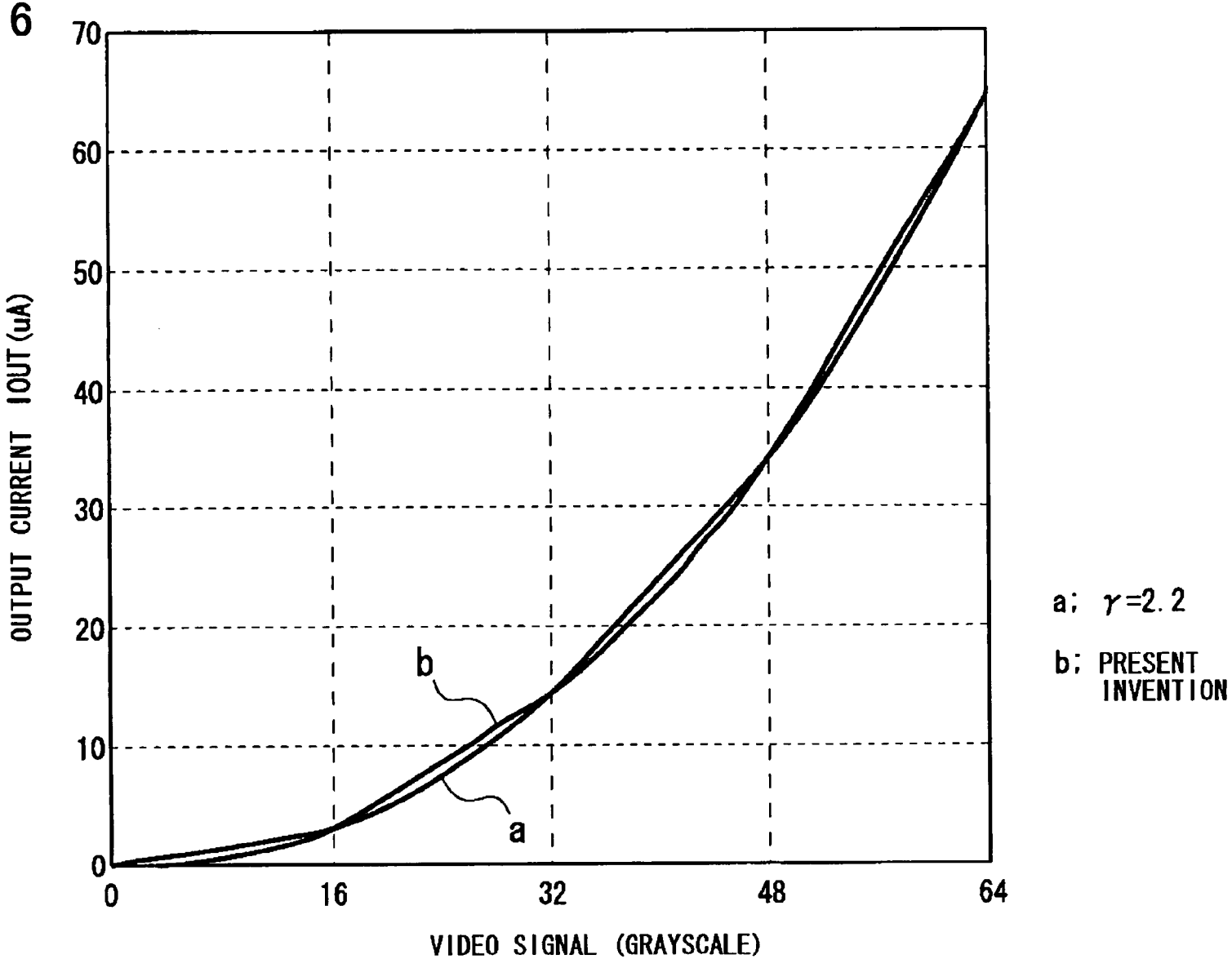
FIG. 6 is a graph illustrating a gamma curve (gamma value=2.2) and input/output characteristic of a 64-grayscale driver circuit for a light-emitting element according to the present invention.

In FIG. 6, a graph a shows a gamma curve (gamma value=2.2), while a graph b shows an example of input/output characteristic of the 64-grayscale driver circuit for a light-emitting element according to the present invention (piece-wise linear approximation characteristic). Referring to FIG. 6, the input/output characteristic b of the 64 grayscales (grayscale 0 to grayscale 63) of the driver circuit for a light-emitting element according to the present invention are set so that the output current $I_{OUT}$ at each of the beginning and terminal ends of each of four intervals of grayscales 0 to 15, 16 to 31, 32 to 47 and 48 to 63 will be coincident with the value of the gamma curve (?=2.2). By variably controlling the value of the reference current $I_{Ref}$ in each interval, the amount of change in the output current (gradient) against change of one grayscale (1 LSB of the video signal), are different, thus realizing piece-wise linear approximation. The output currents across neighboring intervals, such as the output current in the grayscale 15 of the interval 1 and the output current in the grayscale 16 of the interval 2, exhibit smooth continuous transition, thus achieving an optimum approximation. Meanwhile, the gamma curve (?=2.2) presents a curve convexed towards below in each interval against the approximation b according to the present invention. Although the 64 grayscales are divided into four equal intervals, the approximation may be improved in accuracy by increasing the number of intervals.

Figure 7:
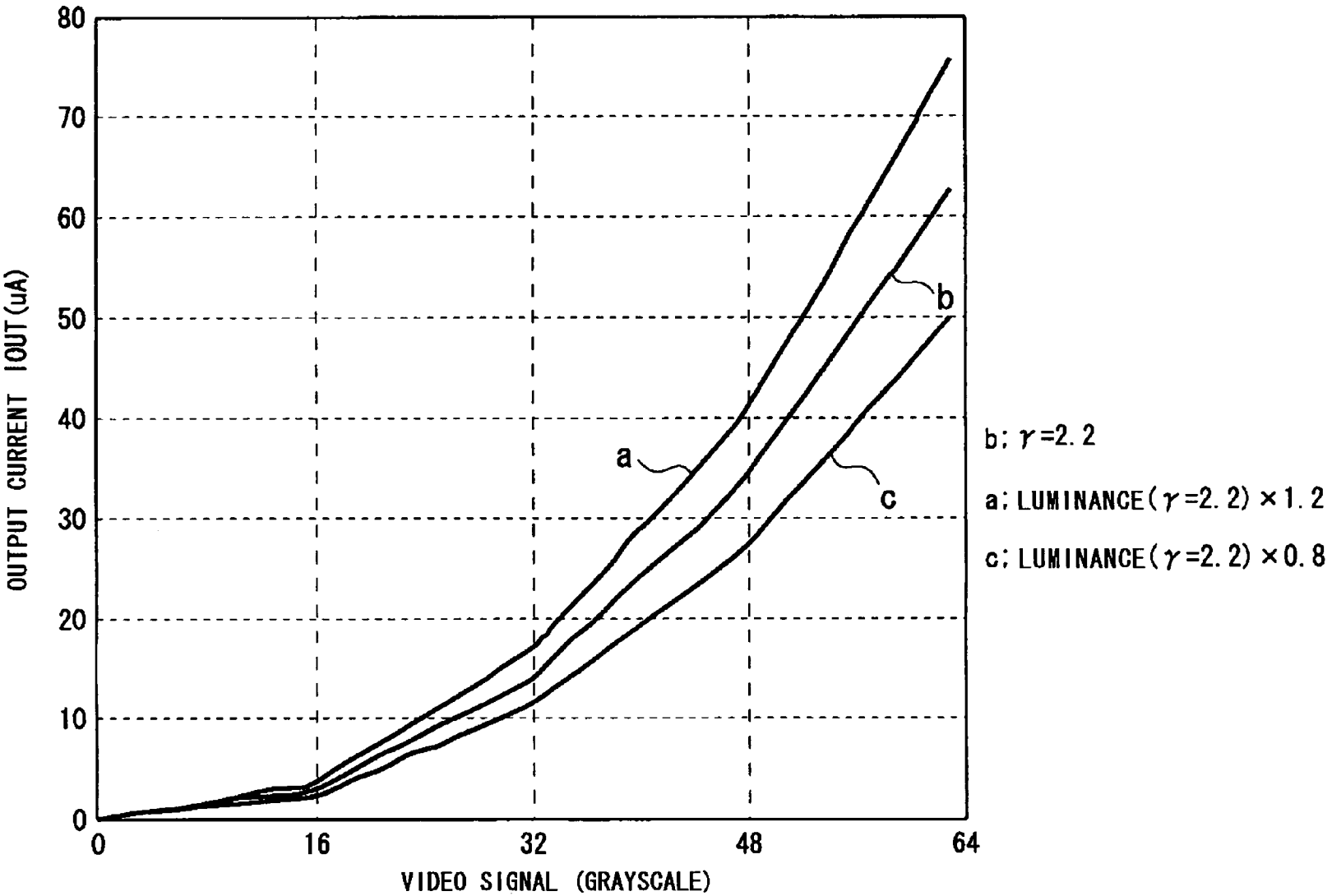
FIG. 7 is a graph illustrating input/output characteristics of a driver circuit for a light-emitting element in the embodiment of the present invention.

FIG. 7 shows input/output characteristics of the driver circuit for a light-emitting element of 64 grayscales in case the value of the reference current $I_{Ref}$ is changed using the panel luminance adjustment signal of FIG. 1. That is, by varying the potential supplied to the current source of the reference current source circuit 12 (see FIG. 2 or 3) by the control voltage $V_{CON}$ output from the panel luminance adjustment circuit 14, the reference current $I_{Ref}$ output from the reference current source circuit 12 is varied to a characteristic equal to 1.2 or 0.8 times the gamma curve (?=2.2). As a result, a desired output current characteristic conforming to the video signal may be obtained. Moreover, the second output current $I_{OUT2}$, output from the second current driver circuit 11, may be varied by the control voltage $V_{CON}$ output from the second current driver circuit 11 to change a characteristic to a characteristic which is equal to 1.2 or 0.8 times the gamma curve (?=2.2), in conjunction with the control of the reference current source circuit 12.

The operating principle of current control by the control voltage $V_{CON}$ is now schematically described. In case the control voltage $V_{CON}$ (and hence the source potential $V_{PCON}$ of FIGS. 2 and 3 and the source potential $V_{NCON}$ of FIGS. 4 and 5) is changed, the gate-to-source voltage $V_{GS}$ of the MOS transistor (current source) shown in FIGS. 2 to 5 is varied and the drain-to-source current $I_{DS}$ is also varied, whereby current values of the reference current $I_{Ref}$, and the second output current $I_{OUT2}$, output from the second current driver circuit 11, may be varied.

Since the luminance of the light emitting element is varied in proportion to the current flowing therein, the overall luminance of the display panel (33 of FIG. 24) may be adjusted by changing the reference current $I_{Ref}$ and the second output $I_{OUT2}$ output from the second current driver circuit 11.

In the present embodiment, the luminance of the display panel is adjusted by a panel luminance adjustment signal input from a control signal input terminal 3. That is, the panel luminance adjustment circuit 14 variably controls the control voltage $V_{CON}$ based on the panel luminance control signal input from the control signal input terminal 3 to adjust the potential $V_{PCON}$ of the reference current source circuit 12 and the potential $V_{NCON}$ of the second current driver circuit 11 to desired voltages. With the present embodiment, having the above configuration, the overall luminance of the display panel in its entirety may be adjusted as the gamma characteristic is maintained. That is, with the driver circuit for a light-emitting element, having the above-described structure, panel luminance adjustment and gamma correction may be achieved simultaneously.

Figure 8:
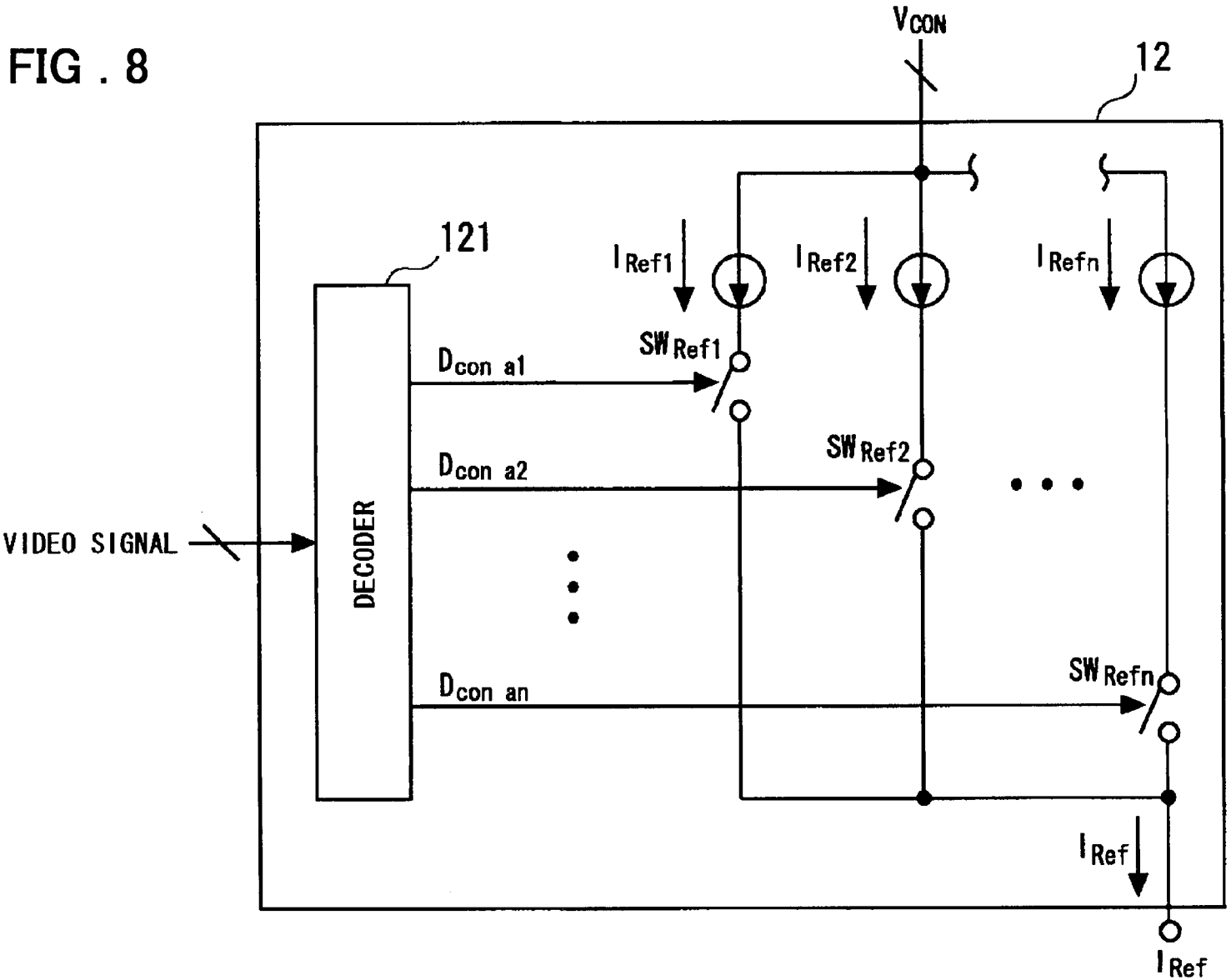
FIG. 8 is a diagram illustrating the configuration of a reference current supply circuit in the embodiment of the present invention.

Several illustrative structures of the reference current source circuit 12 of the present embodiment, shown in FIG. 1, are hereinafter explained. FIG. 8 shows an illustrative structure of the reference current source circuit 12 shown in FIG. 1. Referring to FIG. 8, the reference current source circuit 12 includes n PMOS current sources $I_{Ref1}$ to $I_{Refn}$ and selects the current sources $I_{Ref1}$ to $I_{Refn}$ by the switches $SW_{Ref1}$ to $SW_{Refn}$ to variably control the value of the output current $I_{Ref}$. Meanwhile, the current sources $I_{Ref1}$ to $I_{Refn}$ of FIG. 8 correspond to the PMOS current source transistors $M_{Prefa1}$ to $M_{Prefan}$ of FIG. 2 and to the PMOS current source transistors $M_{Prefn1}$ to $M_{Prefnn}$ of FIG. 3.

The decoder 121 decodes video signal to output control signals $D_{cona1}$ to $D_{conan}$. The switches $SW_{Ref1}$ to $SW_{Refn}$ have one ends connected to output terminals of the PMOS current sources $I_{Ref1}$ to $I_{Refn}$, while having the opposite ends connected in common and having control terminals supplied with the control signals $D_{cona1}$ to $D_{conan}$ from the decoder 121. A common connection point of the switches $SW_{Ref1}$ to $SW_{Refn}$ is connected to an output terminal of the reference current $I_{Ref}$. The current values of the PMOS current sources $I_{Ref1}$ to $I_{Refn}$ are weighted with preset weight values, such that the current values of the reference current $I_{Ref}$ may be varied by the current sources $I_{Ref1}$ to $I_{Refn}$, as selected by the switches $SW_{Ref1}$ to $SW_{Refn}$.

The reference current $I_{Ref}$ determines the amount of change (unit change amount) in the output current when the digital video signal is changed by one LSB, such that, by changing the reference current $I_{Ref}$, the amount of the current changed by each LSB may be changed depending on the value of the video signal (grayscale). The amount of the current changed for one LSB of the video signal, that is, the input/output characteristic, may be changed responsive from interval to interval, in order to realize optional non-linearity for each interval. Since the lower the grayscale, the more curved is the characteristic of the gamma characteristic, and the higher the grayscale, the more linear is the characteristic thereof, the video signal supplied to the first current driver circuit 10 (totality of bits) are used as the video signal supplied to the reference current source circuit 12. That is, in the reference current source circuit 12, all of the k bits corresponding to $2^k$ grayscales are used for control. As a modification, a preset number of bits (k bits) of the video signal may be input.

By providing n PMOS current sources $I_{Ref1}$ to $I_{Refn}$ in the reference current source circuit 12, the $2^k$ grayscales can be divided into n or more intervals. Since the current values, supplied to the light emitting elements in association with video signal, is known from the outset, the current weighting of the n PMOS current sources $I_{Ref1}$ to $I_{Refn}$ is set so that the necessary current will be output from the driver circuit for a light-emitting element responsive to the video signal.

FIG. 9 shows a truth table illustrating the operation of the decoder 121 (see FIG. 8) for driving the current source of the reference current source circuit 12, formed by four current sources (n=4 in FIG. 8), for the 64-grayscale (6-bit) video signal, in terms of the correspondence between the video signal and the control signals $D_{cona1}$ to $D_{conan}$. In FIG. 9, numerals 1, 0 denote switch on and off, respectively. In FIG. 9: in an interval 1 for the video signal 0 to 15, the control signal $D_{cona1}$ is "1", the switch $SW_{Ref1}$ is turned on, with reference current $I_{Ref}=I_{Ref1}$.

In an interval 2 for the video signal 16 to 31, the control signal $D_{cona2}$ is "1", the switch $SW_{Ref2}$ is turned on, with reference current $I_{Ref}=I_{Ref2}$.

In an interval 3 for the video signal 32 to 47, the control signal $D_{cona3}$ is "1", the switch $SW_{Ref3}$ is turned on, with reference current $I_{Ref}=I_{Ref3}$.

In an interval 4 for the video signal 48 to 63, the control signal $D_{cona4}$ is "1", the switch $SW_{Ref4}$ is turned on, with reference current $I_{Ref}=I_{Ref4}$.

In the example shown in FIG. 9, the 64 grayscales are divided into equal four intervals. However, with the present invention, the number of intervals of dividing the totality of the grayscales and the interval of the intervals may suitably be changed as necessary. Moreover, in the example shown in FIG. 9, the number of the current sources selected out of the four current sources is one, however, plural current sources may also be selected.

Figure 10:
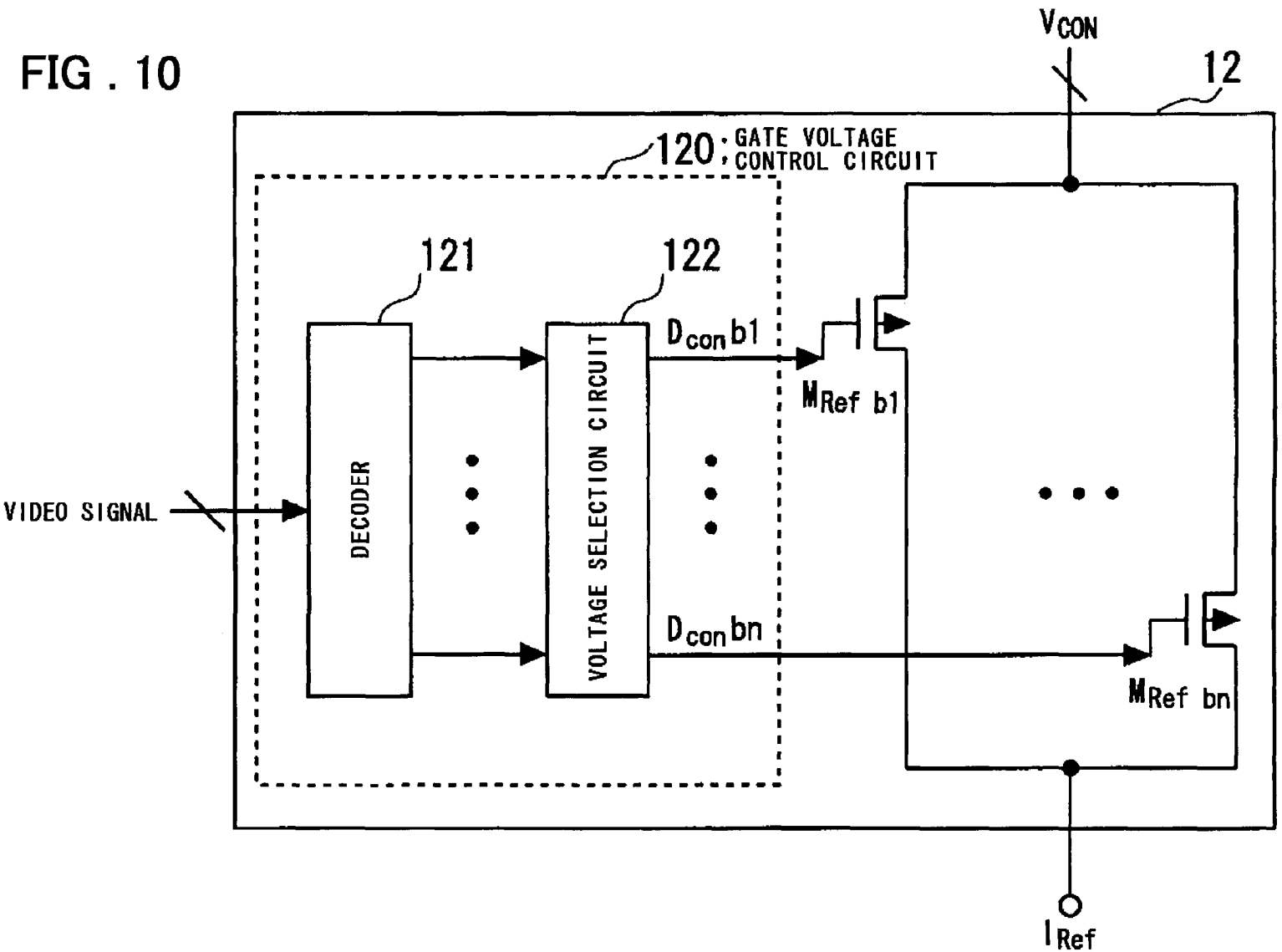
FIG. 10 is a diagram illustrating another configuration of a driver circuit for a light-emitting element according to an embodiment of the present invention.

FIG. 10 shows another illustrative structure of the reference current source circuit 12. Referring to FIG. 10, the reference current source circuit 12 is made up by one or more PMOS transistors (PMOS current sources) $M_{Ref}$ b1 to $M_{Ref}$ bn. The output current $I_{Ref}$ of the reference current source circuit 12 is controlled by controlling the gate voltage (bias voltage) of the PMOS transistors $M_{Ref}$ b1 to $M_{Ref}$ bn.

The gate voltages of the $M_{Ref}$ b1 to $M_{Ref}$ bn are set to the voltages of control signals $D_{con}$ b1 to $D_{con}$ bn, output from a voltage selection circuit 122. The voltage selection circuit 122 determines the voltages of the control signals $D_{con}$ b1 to $D_{con}$ bn, based on the decoded signal output from the decoder 121 supplied with the video signal. The decoder 121 and the voltage selection circuit 122 form a gate voltage control circuit 120 controlling the gate voltage based on input video signal.

Figure 11:
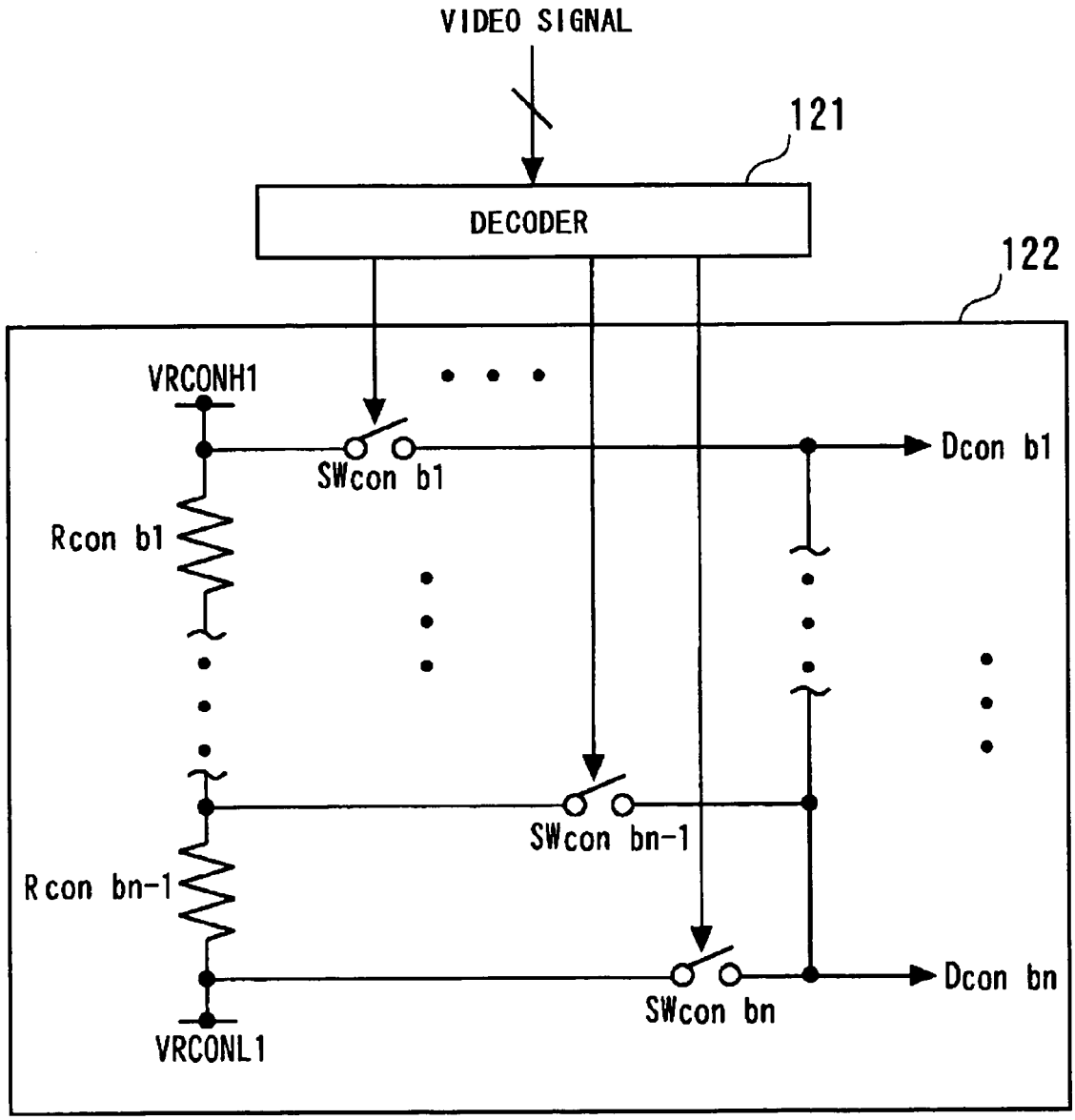
FIG. 11 is a diagram illustrating a configuration of a voltage selection circuit of the reference current supply circuit of FIG. 10.

FIG. 11 shows an illustrative structure of the voltage selection circuit 122 of FIG. 10. Referring to FIG. 11, the voltage selection circuit 122 includes a resistor string, made up by resistors $R_{con}$ b1 to $R_{con}$ bn−1, connected in series between a high side reference potential VRCONH1 and a low side reference potential VRCONL1, reference potentials VRCONH1 and VRCONL1, junctions (taps) of resistors $R_{con}$ b1 to $R_{con}$ bn−1, and switches $SW_{con}$ b1 to $SW_{con}$ bn, the control terminals of which are supplied with an output signal form the decoder 121. The selection circuit selects the gate voltage needed for the current source transistors of the reference current source circuit 12, by turning the switches $SW_{con}$ b1 to $SW_{con}$ bn on or off, to output the selected gate voltage from the output terminals $D_{con}$ b1 to $D_{con}$ bn.

Figure 12:
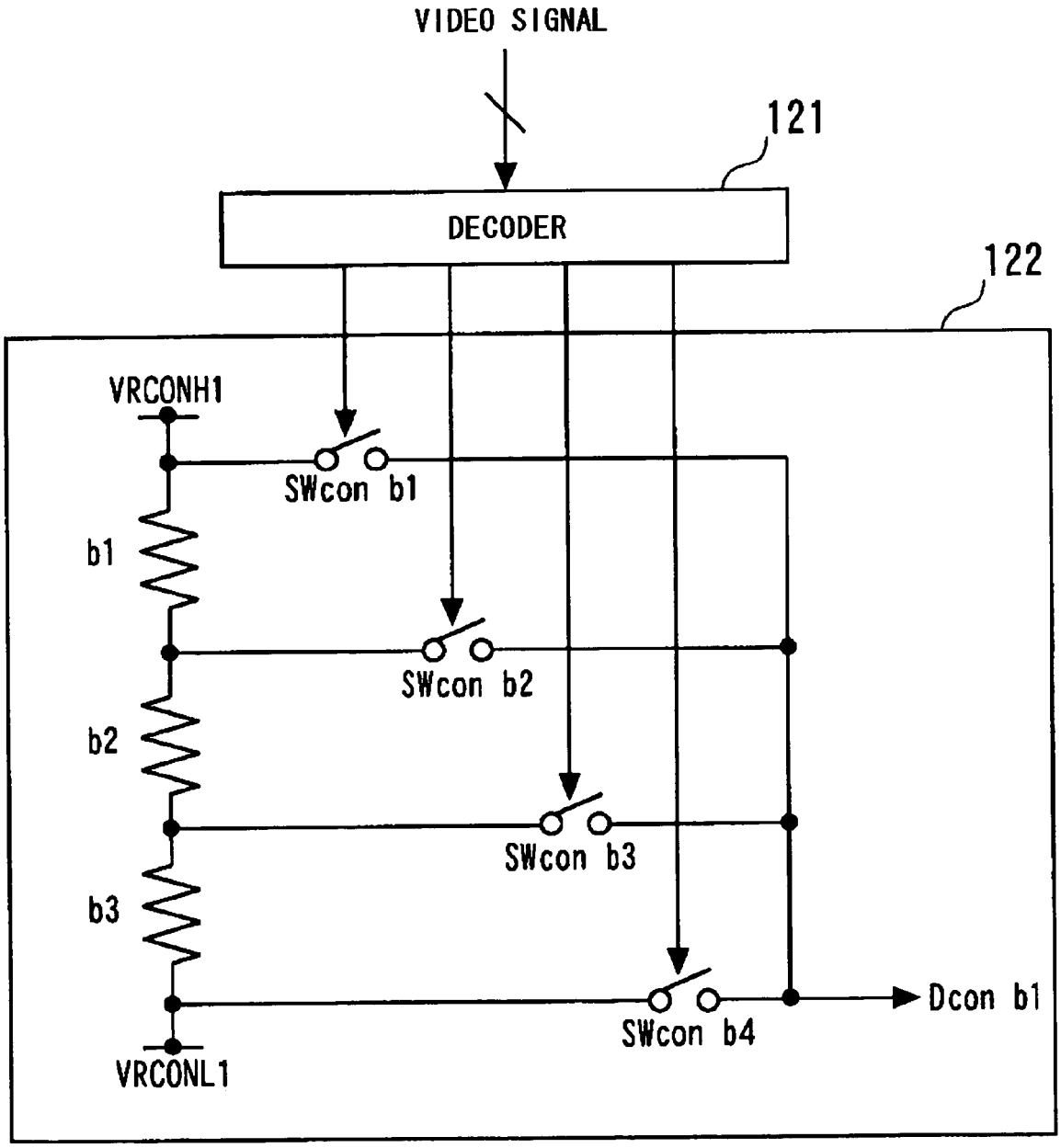
FIG. 12 is a diagram illustrating another configuration of a voltage selection circuit of the reference current supply circuit of FIG. 10.

FIG. 12 shows an exemplary configuration in which the 64 grayscales are partitioned equally into four intervals in the voltage selection circuit 122 of FIG. 11. The configuration shown in FIG. 12 corresponds to the configuration of FIG. 11 in which four switches $SW_{con}$ b1 to $SW_{con}$ b4 are used as the n switches $SW_{con}$ b1 to $SW_{con}$ bn and the resistor string is formed by resistors b1, b2 and b3. The taps of the resistor string, made up by resistors b1 to b3, are four junctions, that is, the high side reference potential VRCONH1, low side reference potential VRCONL1, a junction of the resistors b1 and b2, and a junction of the resistors b2 and b3. A selection circuit, made up by four switches $SW_{con}$ b1 to $SW_{con}$ b4, is inserted between the four taps and an output terminal $D_{con}$ b1. The selection circuit selects one of the four potentials, based on the decoded signal from the decoder 121, to output the selected potential to the output terminal $D_{con}$ b1.

FIG. 13 shows an exemplary operation of the voltage selection circuit 122 of FIG. 12 (truth table). The truth table of FIG. 13 corresponds to a case in which the current source of the reference current source circuit 12 of FIG. 10 is made up by a sole transistor (PMOS transistor $M_{Ref}$ b1 of FIG. 10).

Referring to FIGS. 12 and 13, in the interval 1, out of four intervals obtained on equally dividing the 64 grayscales (0 to 63), the switch $SW_{con}$ b1 is turned on, with the voltage output from the output terminal $D_{con}$ b1 being VRCONH1.

In the interval 2, only the switch $SW_{con}$ b2 is turned on. The voltage output from the output terminal $D_{con}$ b1 of the voltage selection circuit 122 is the voltage obtained on voltage division of the potential between the high side reference potential VRCONH1 and the low side reference potential VRCONL1 by resistance values b1 and (b2+b3), and is given by the following equation (7):

$$D_{con}b1=\mathrm{VRCONL1}+(\mathrm{VRCONH1}-\mathrm{VRCONL1})\times(b2+b3)/(b1+b2+b3)=\{\mathrm{VRCONH1}\times(b2+b3)+\mathrm{VRCONL1}\times b1\}/(b1+b2+b3) \quad (7).$$

In the interval 3, only the switch $SW_{con}$ b3 is turned on. The voltage output from the output terminal $D_{con}$ b1 of the voltage selection circuit 122 is the voltage obtained on voltage division of the potential between the high side reference potential VRCONH1 and the low side reference potential VRCONL1 by resistance values (b1+b2) and b3, and is given by the following equation (8):

$$D_{con}b1=\mathrm{VRCONL1}+(\mathrm{VRCONH1}-\mathrm{VRCONL1}\times b3/(b1+b2+b3)=\{\mathrm{VRCONH1}\times b3+\mathrm{VRCONL1}\times(b1+b2)\}/(b1+b2+b3) \quad (8).$$

In the interval 4, only the switch $SW_{con}$ b4 is turned on. The voltage output from the output terminal $D_{con}$ b1 of the voltage selection circuit 122 is given by the low side reference potential VRCONL1.

In FIGS. 11 and 12, the configuration of the voltage selection circuit 122, in which the tap voltage of the resistor string is selected by a switch forming the selection circuit, and output, has been explained. The present invention is, however, not limited to this configuration. For example, the reference current, output from the reference current source circuit 12, may be changed by memorizing data of voltage values in a memory, not shown, accessing a memory, based on video signal or decoded results by the decoder 121 of the video signal, to read out voltage value data, and by selecting or converting the corresponding analog voltage, based on voltage value data, to control the gate voltage of the current source transistor (PMOS transistor $M_{Ref}$ b1 of FIG. 10).

Figure 14:
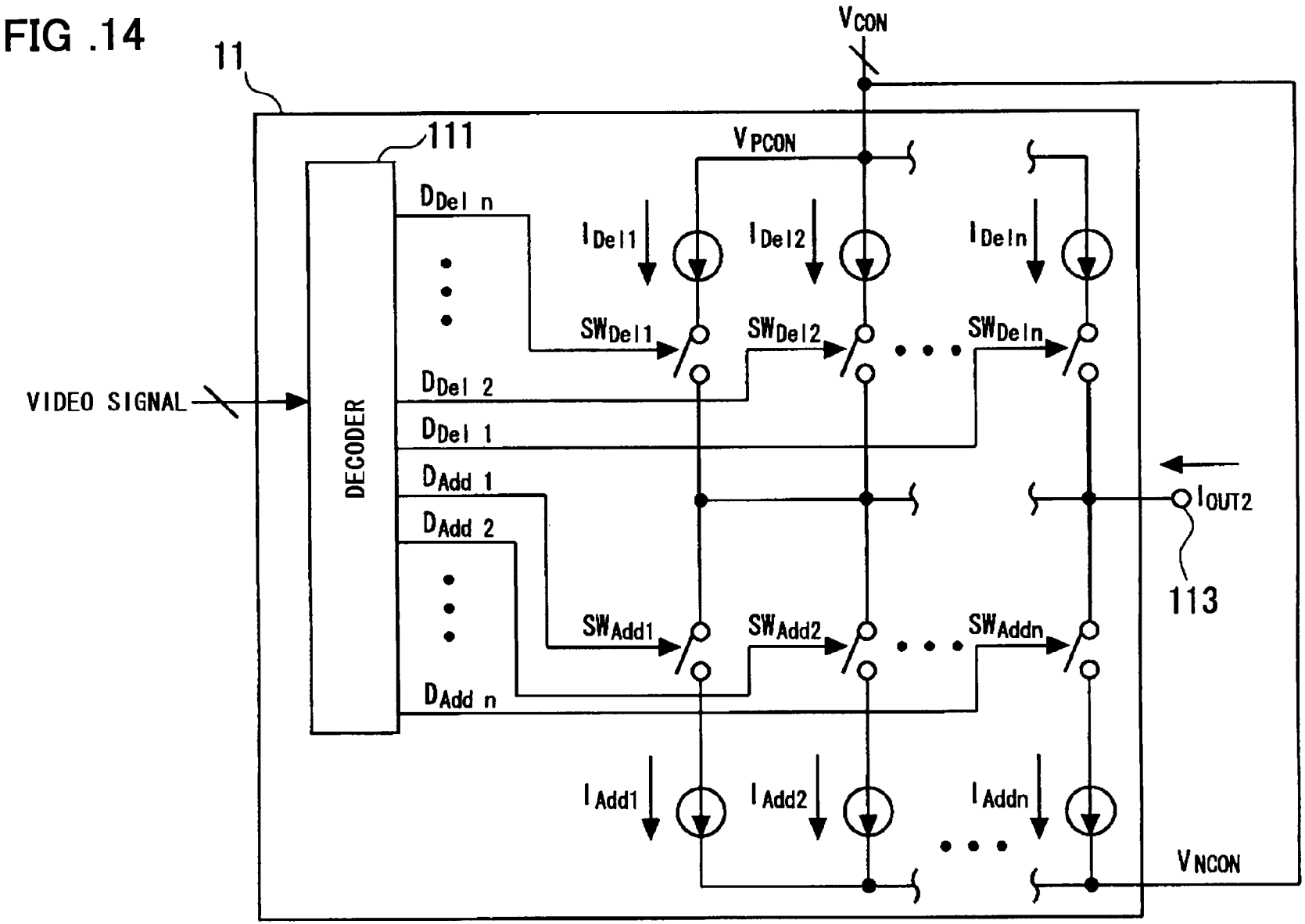
FIG. 14 is a diagram illustrating a configuration of a second current driver circuit according to an embodiment of the present invention.

The configuration of the second current driver circuit 11 of the present embodiment, shown in FIG. 1, is now described. FIG. 14 shows an exemplary configuration of the second current driver circuit 11 of FIG. 1. The second current driver circuit 11 makes corrections to cause the input/output characteristic of the output current of the driver circuit for a light-emitting element of the $2^k$ grayscales to approach to the gamma characteristic.

Referring to FIG. 14, the second current driver circuit 11 includes a decoder 111 for being supplied with and decoding the video signal, current sources (PMOS current sources) $I_{De1}$1 to $I_{De1}$n, having one ends connected to the potential $V_{PCON}$, and switches $SW_{De1}$1 to $SW_{De1}$n, connected between the output ends of the current sources $I_{De1}$1 to $I_{De1}$n and the output terminal 113 and having control terminals supplied with control signals $D_{De1}$1 to $D_{De1}$n from the decoder 111. The second current driver circuit also includes current sources (NMOS current sources) $I_{Add1}$ to $I_{Addn}$ having one ends connected to the potential $V_{NCON}$, and switches $SW_{Add1}$ to $SW_{Addn}$ connected between output ends of the switches $SW_{Add1}$ to $SW_{Addn}$ and the output terminal 113 and having control terminals supplied with the control signals $D_{Add1}$ to $D_{Addn}$ from the decoder 111. The PMOS current sources $I_{Add1}$ to $I_{Addn}$ supplying the source current to the output terminal 113 and NMOS current sources $I_{De1}$1 to $I_{De1}$n, supplying the sink current to the output terminal 113, are the current sources for addition and subtraction, respectively. The switches $SW_{Add1}$ to $SW_{Addn}$ and $SW_{Add1}$ to $SW_{Addn}$ control the current sources for addition and for subtraction, and the values of the currents flowing through the current sources are adjusted from the outset so as to match to the gamma characteristic. In FIG. 14, the output terminal 113 is connected to the output terminal 2 of FIG. 1.

Figure 15:
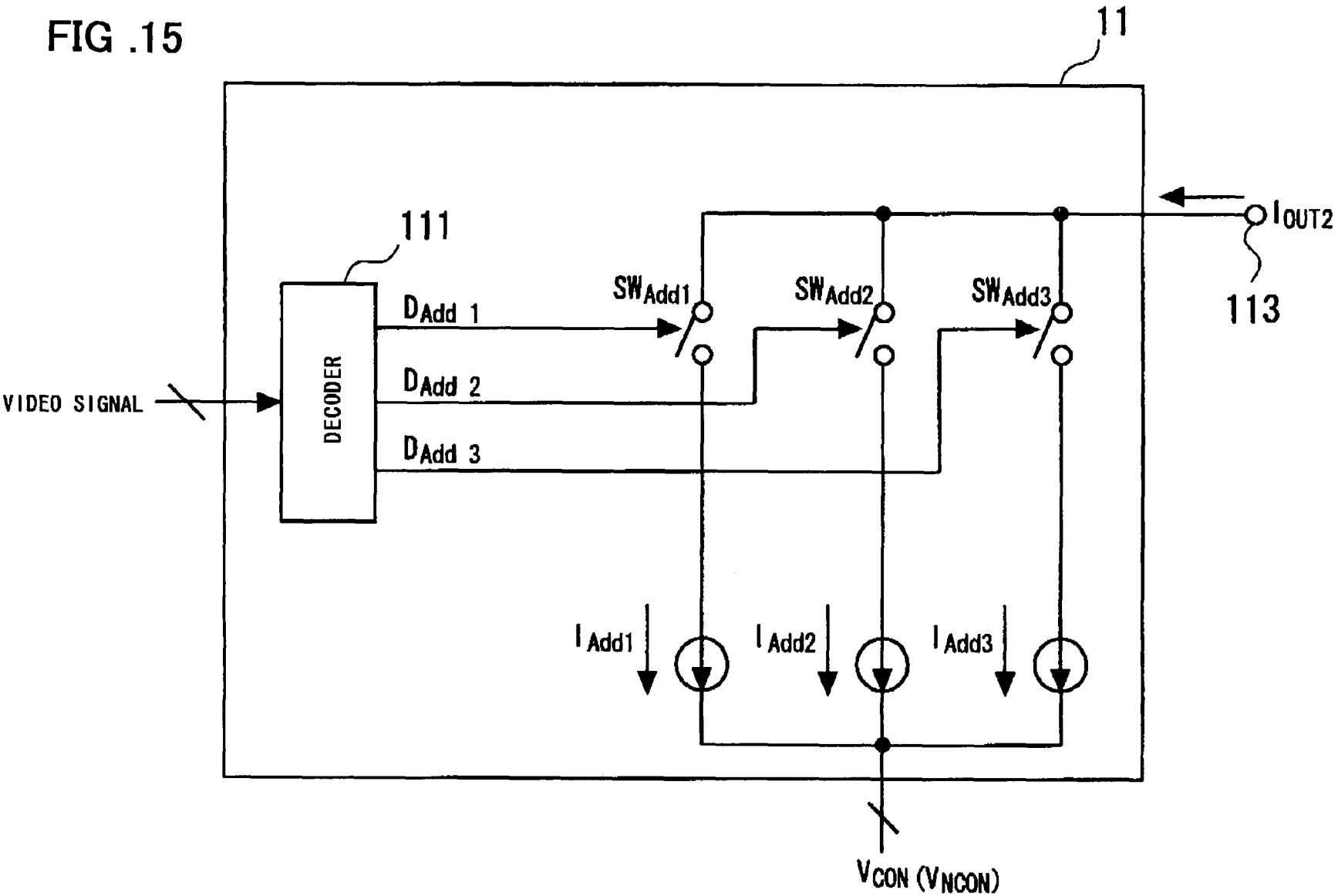
FIG. 15 is a diagram illustrating another configuration of a second current driver circuit according to an embodiment of the present invention.

FIG. 15 shows an exemplary structure in which only the current source for addition is used in the second current driver circuit 11 of FIG. 14. FIG. 16 depicts a truth table for explaining the operation of the decoder 111 of FIG. 15 in case 64 grayscales are equally divided into four intervals.

Referring to FIG. 15, the second current driver circuit 11 includes a decoder 111, which receives and decodes the video signal, a plurality of current sources (NMOS current sources) $I_{Add1}$ to $I_{Add3}$, having one ends connected to the potential $V_{NCON}$ and a plurality of switches $SW_{Add1}$ to $SW_{Add3}$ connected between the output ends of the current sources $I_{Add1}$ to $I_{Add3}$ and the output terminal 113 and having control terminals supplied with the control signals $D_{Add1}$ to $D_{Addn}$ from the decoder 111. The NMOS current sources $I_{Add1}$ to $I_{Add3}$, supplying the sink current $I_{OUT2}$ to the output terminal 113, represent current sources for addition and control the switches $SW_{Add1}$ to $SW_{Add3}$ on or off with the control signals $D_{Add1}$ to $D_{Addn}$ to variably control the current value.

Referring to FIGS. 15 and 16, the control signals $D_{Add1}$ to $D_{Add3}$ are "0", the switches $SW_{Add1}$ to $SW_{Add3}$ are all off and the second output current $I_{OUT2}$ is 0 uA, in the second current driver circuit 11, for the domain of the video signal of 0 to 15. The output current $I_{OUT}$ is supplied from the first output current $I_{OUT1}$ of the first current driver circuit 10.

In the interval 2, with the video signal from 16 to 31, the control signal $D_{Add1}$ is "1", the switch $SW_{Add1}$ is on and the second output current $I_{OUT2}$ is $I_{Add1}$.

In the interval 3, with the video signal from 32 to 47, the control signal $D_{Add1}$ is "1", the switch $SW_{Add2}$ is on and the second output current $I_{OUT2}$ is $I_{Add2}$.

In the interval 4, with the video signal from 48 to 63, the control signal $D_{Add3}$ is "1", the switch $SW_{Add3}$ is on and the second output current $I_{OUT2}$ is $I_{Add3}$.

If, in the interval 1, the video signal is 15, the switches $SW_1$ to $SW_4$ (see FIG. 1) in the first current driver circuit 10 are all on, while the control signal $D_{cona1}$ of the reference current source circuit 12 (see FIG. 8) is on (see FIG. 9), so that the first output current $I_{OUT1}=15\times I_{Ref1}$, where $I_{Ref1}$ is the current value of the current source $I_{Ref1}$ of the reference current source circuit 12, is output from the first current driver circuit 10.

If, in the interval 2, the video signal is 16, the switches $SW_1$ to $SW_4$ (see FIG. 1) in the first current driver circuit 10 are all off, while the first output current $I_{OUT1}$ of the first current driver circuit 10 is 0 uA. In the interval 2, the switch $SW_{Add1}$ of the second current driver circuit 11 is on, as aforesaid, while the second output current $I_{OUT2}$ is $I_{Add1}$.

Thus, in the present embodiment, the current $$I_{OUT2}=I_{Add1}=16\times I_{Ref1} \tag{9}$$

is output, so that the output current $I_{OUT}$ of the driver circuit for a light-emitting element is $$I_{OUT}=I_{OUT1}+I_{OUT2}=16\times I_{Ref1} \tag{10}$$

where $I_{Ref1}$ is the current value of the current source $I_{Ref1}$ of the reference current source circuit 12 of FIG. 8.

That is, in the present embodiment, the current of the current source $I_{Add1}$ of the second current driver circuit 11 (see FIG. 15) is set to 16 times as large as the current value of the current source $I_{Ref1}$ of the reference current source circuit 12 of FIG. 8.

With the video signal 17, the switch $SW_1$ out of the switches $SW_1$ to $SW_4$ (see FIG. 1) in the first current driver circuit 10 is turned on, the first output current $I_{OUT1}$ is $2^0\times I_{Ref1}$, the control signal $D_{con}$ a2 of the reference current source circuit 12 (see FIG. 9) is "1", the switch $SW_{Add1}$ in the second current driver circuit 11 is turned on, the second output current $I_{OUT2}$ is $I_{Add1}$ and the output current $I_{OUT}$ is $$i\times I_{Ref1}+I_{Add1} \tag{11}$$

In similar manner, the output current $I_{OUT}$ is $i\times I_{Ref3}+I_{Add2}$ for the interval 3, where i is an integer from 0 to 15, and is $i\times I_{Ref4}+I_{Add3}$ for the interval 3, where i is an integer from 0 to 15.

FIG. 16 shows the truth table of the second current driver circuit 11 performing the function of upper j bits. By a configuration in which the current is added or subtracted using the current source for correction (that is, using an NMOS current source for addition and a PMOS current source for subtraction), the gamma characteristic may be realized to higher accuracy.

Figure 17:
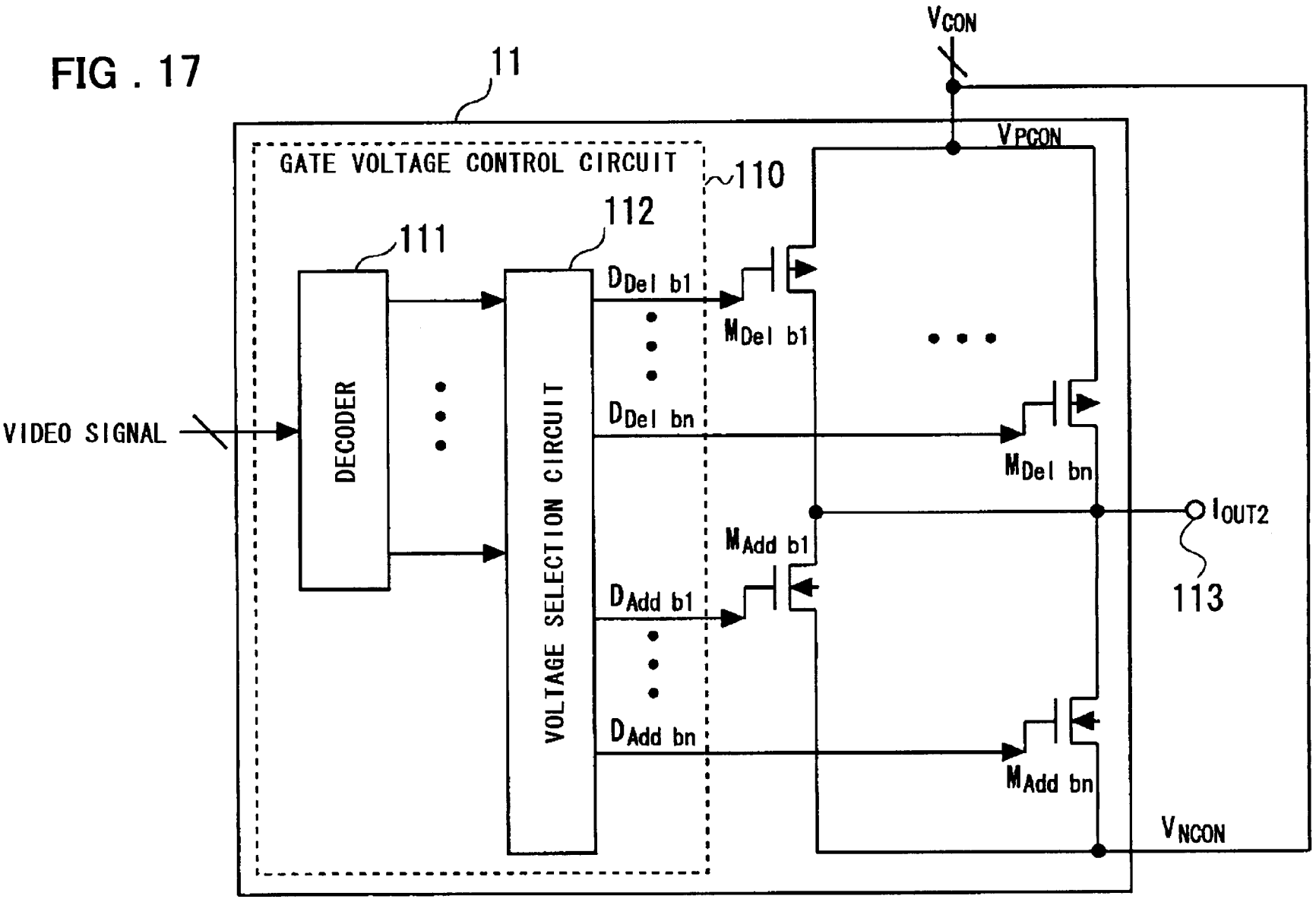
FIG. 17 is a diagram illustrating a further configuration of a second current driver circuit according to an embodiment of the present invention.

FIG. 17 shows another illustrative configuration of the second current driver circuit 11 of FIG. 1. Referring to FIG. 17, the second current driver circuit 11 includes PMOS transistors $M_{De1}$ b1 to $M_{De1}$ bn, having sources connected in common to the potential $V_{PCON}$ and having gates supplied with control signals $D_{De1}$ b1 to $D_{De1}$ bn, and NMOS transistors $M_{Addb1}$ to $M_{Addbn}$ having sources connected in common to the potential $V_{NCON}$ and having gates supplied with control signals $D_{Add}$ b1 to $D_{Add}$ bn. The drains of the NMOS transistors $M_{Add}$ b1 to $M_{Add}$ bn are connected in common to the output terminal 113. The control signals $D_{De1}$ b1 to $D_{De1}$ bn and the control signals $D_{Add}$ b1 to $D_{Add}$ bn are output from a voltage selection circuit 112. This voltage selection circuit 112 outputs control signals $D_{De1}$ b1 to $D_{De1}$ bn and the control signals $D_{Add}$ b1 to $D_{Add}$ bn, based on the decoded signal from the decoder 111, configured for being supplied with and decoding the video signal. The decoder 111 and the voltage selection circuit 112 make up a gate voltage controlling circuit 110.

In the configuration shown in FIG. 14, the second current driver circuit 11 controls the second output current $I_{OUT2}$ by the switches $SW_{Del1}$ to $SW_{De1}$n and the switches $SW_{Add1}$ to $SW_{Addn}$. In the configuration shown in FIG. 17, the current value of the second output current $I_{OUT2}$ is variably controlled by controlling the gate voltage of the transistors of the PMOS and NMOS current sources.

In the configuration shown in FIG. 14, plural current sources are needed. In the configuration shown in FIG. 17, configured for variably controlling the output current by varying the gate voltage, the current source transistor is formed by a sole transistor, thereby further reducing the circuit size.

Figure 18:
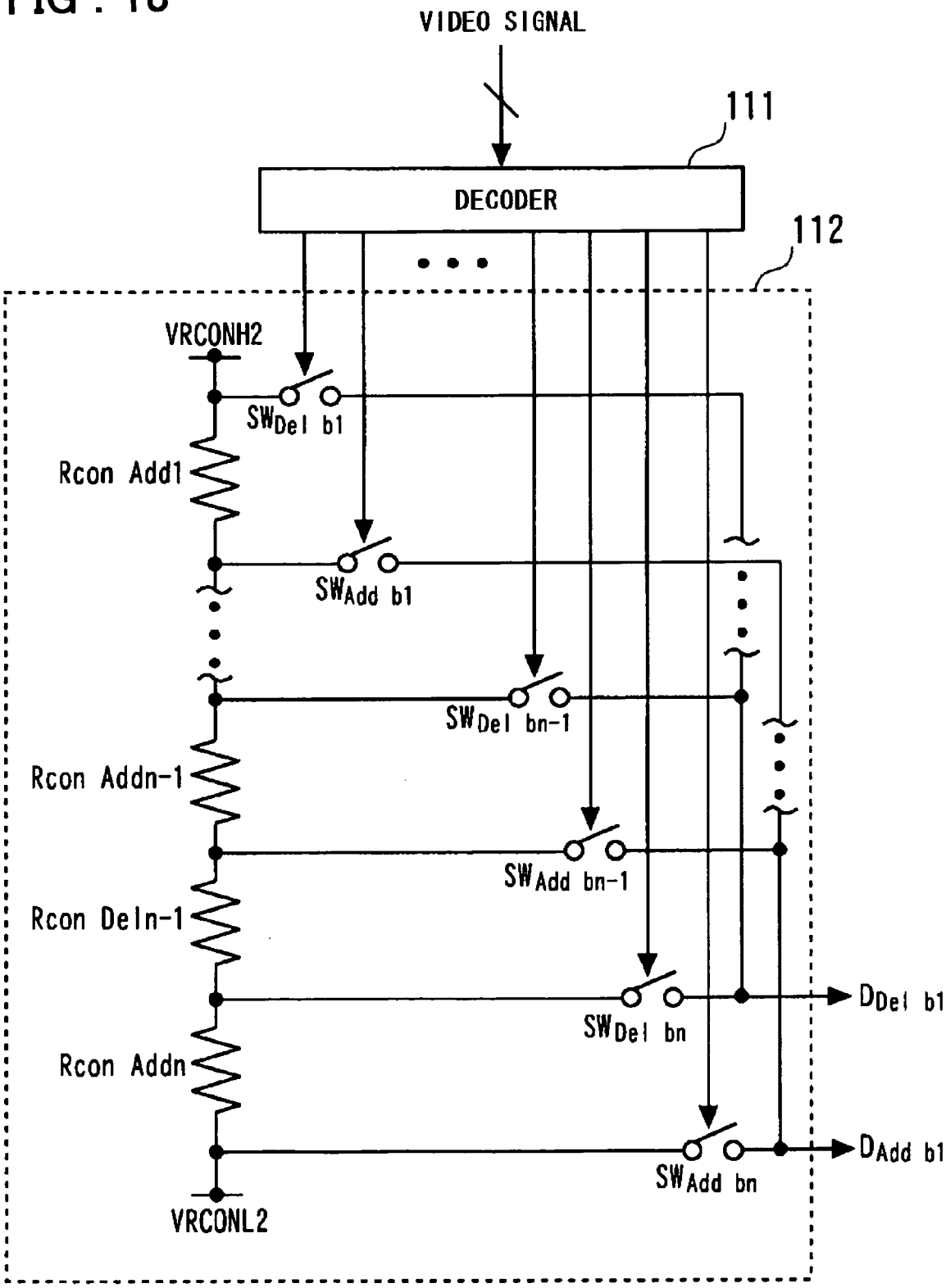
FIG. 18 is a diagram illustrating a configuration of a voltage selection circuit of the second current driver circuit shown in FIG. 17.

FIG. 18 shows an illustrative configuration of the voltage selection circuit 112 of FIG. 17. In FIG. 18, the voltage selection circuit 112 includes resistors $R_{con}$ Add1, $R_{con}$ Del1 (not shown), $R_{con}$ Add2 (not shown), $R_{con}$ Del2 (not shown) to $R_{con}$ Addn-1, $R_{con}$ Deln-1 (not shown), $R_{con}$ Addn, totaling at 2×n−1, connected in series with one another between the high side reference potential VRCONH1 and the low side reference potential VRCONL1. To the output terminal $D_{De1}$ b1 are connected the potential VRCONH2, a junction between resistors $R_{con}$ Del1 and $R_{con}$ Add2 and a junction between resistors $R_{con}$ Deln-1 and $R_{con}$ Addn via switches $SW_{De1}$ b1, $SW_{De1}$ b2 to $SW_{De1}$ bn. To the output terminal $D_{Add}$ b1 are connected a junction between resistors $R_{con}$ Add1 and $R_{con}$ Del1, a junction between resistors $R_{con}$ Addn-1 and $R_{con}$ Deln-1 and the potential VRCONH2 via switches $SW_{Add}$ b1, $SW_{Add}$ b2 and $SW_{Add}$ bn. By turning the $SW_{Add}$ b1 to $SW_{De1}$ bn on or off, the gate voltage as needed is selected by the power supply transistors $M_{De1}$ b1, $M_{De1}$ bn and $M_{Add}$ bn of the second current driver circuit 11, and output at output terminals $D_{De1}$ b1 to $D_{Add}$ b1. Or, the voltage values may be stored in a memory, not shown, and the information is invoked to control the transistor gate voltage.

Figure 19:
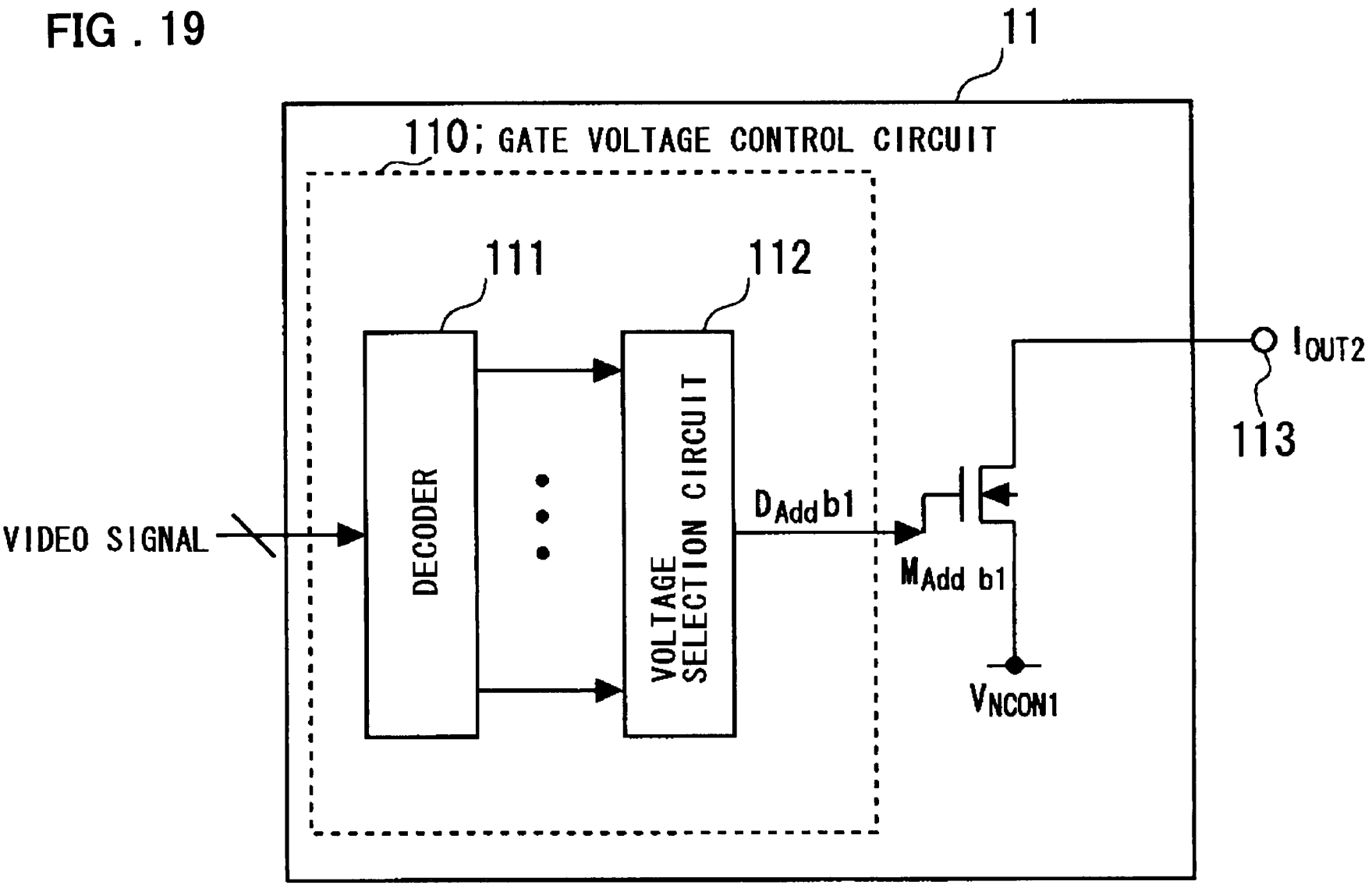
FIG. 19 is a diagram illustrating a further configuration of a second current driver circuit according to an embodiment of the present invention.

FIG. 19 shows another illustrative configuration of the second current driver circuit 11 of FIG. 1. Referring to FIG. 19, the PMOS current sources $M_{De1}$ b1 to $M_{De1}$ bn of FIG. 17 are omitted and only the NMOS transistor $M_{Add}$ b1 is provided. The voltage selection circuit 112 sends the control signal $D_{Add}$ b1 to the gate of the NMOS transistor $M_{Add}$ b1.

Figure 20:
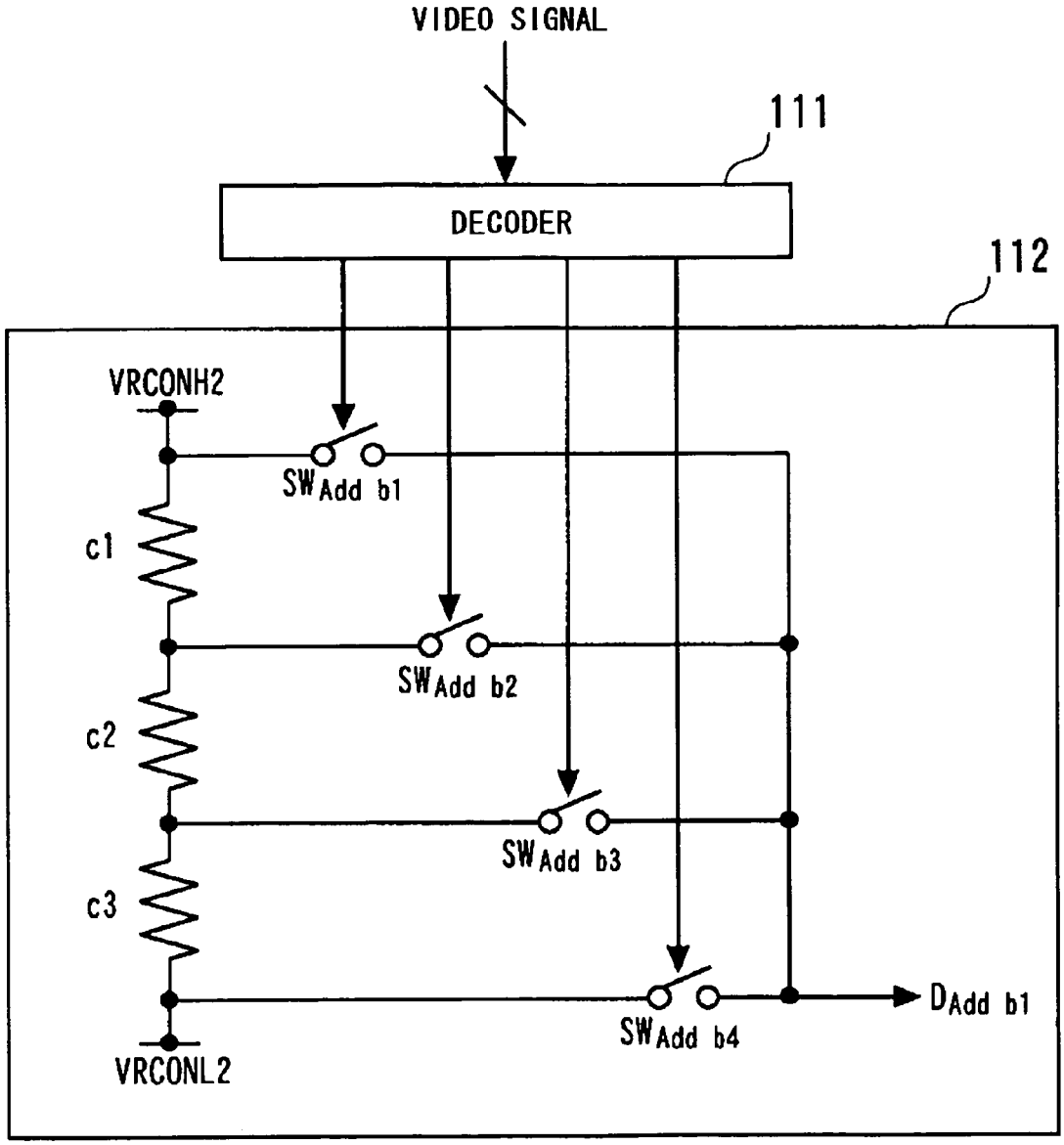
FIG. 20 is a diagram illustrating a configuration of the voltage selection circuit of the second current driver circuit shown in FIG. 19.

FIG. 20 shows the configuration of the voltage selection circuit 112 of FIG. 19. Referring to FIG. 20, the voltage selection circuit 112 includes a resistor string, made up by three resistors c1 to c3, connected in series between the high side reference potential VRCONH2 and the low side reference potential VRCONL2. To the output terminal $D_{Add}$ b1 are connected the potential VRCONH2, a junction between the resistors c1 and c2 and the potential VRCONL2, via switches $SW_{Add}$ b1, $SW_{Add}$ b2 and $SW_{Add}$ b3.

FIG. 21 is a truth table for illustrating the operation of the voltage selection circuit 112 in case 64 grayscales are equally divided into four intervals (see FIG. 20). In the interval 1, in the voltage selection circuit 112 in FIG. 20, the switch $SW_{Add}$ b1, out of the switches $SW_{Add}$ b1 to $SW_{Add}$ b4, is turned on, with the $D_{Add}$ b1 being VECONH2.

In the interval 2, the switch $SW_{Add}$ b2, out of the switches $SW_{Add}$ b1 to $SW_{Add}$ b4, in the voltage selection circuit 112 in FIG. 20, is turned on, with the $D_{Add}$ b1 being $$D_{Add}b1=\text{VRCONL2}+(\text{VRCONH2}-\text{VRCONL2})\times c3/(c1+c2+c3)=\{\text{VRCONH2}\times(c2+c3)+\text{VRCONL2}\times c\}/(c1+c2+c3) \quad (12).$$

In the interval 3, the switch $SW_{Add}$ b3, out of the switches $SW_{Add}$ b1 to $SW_{Add}$ b4, in the voltage selection circuit 112 in FIG. 20, is turned on, with the $D_{Add}$ b1 being $$D_{Add}b1=\text{VRCONL2}+(\text{VRCONH2}-\text{VRCONL2})\times(c2+c3)/(c1+c2+c3)=\{\text{VRCONH2}\times c3+\text{VRCONL2}\times(c1+c2)\}/(c1+c2+c3) \quad (13).$$

In the interval 4, the switch $SW_{Add}$ b3, out of the switches $SW_{Add}$ b1 to $SW_{Add}$ b4, in the voltage selection circuit 112 in FIG. 20, is turned on, with the $D_{Add}$ b1 being VRCONL2.

In FIG. 21, there is shown a truth table of the second current driver circuit 11 performing the function of upper j bits. It is noted that gamma characteristics may be achieved to higher accuracy by using a current source for correction (an NMOS current source for addition and a PMOS current source for subtraction) and adding/subtracting the current.

The panel luminance adjustment circuit 14 of FIG. 1 is now explained. This panel luminance adjustment circuit 14 controls the reference current source circuit 12, and the source potential of the PMOS and NMOS current sources of the second current driver circuit, by a luminance adjustment signal entered via a terminal. In general, in case a MOS transistor is used as a current source, the saturation domain of the transistor is used. The drain current in the MOS transistor is expressed by $$I_D=\beta\{V_{GS}-V_T\}2 \quad (14).$$

In the above equation, $I_D$ is the drain current, β is the gain coefficient, β=μCoxW/L, where μ is the mobility of electrons, Cox is the gate capacitance per unit, W is a channel width, L is a channel length, $V_{GS}$ is a source to gate voltage and $V_T$ is a threshold voltage.

It is seen from the above equation (14) that, if the gate-to-source voltage $V_{GS}$ of the MOS transistor is changed, the value of the current $I_D$ flowing through the MOS transistor is changed.

If the panel luminance adjustment signal is given as a voltage value and may directly be supplied as the source voltage of the PMOS and NMOS current sources, there is no necessity of providing the panel luminance adjustment circuit 14 of FIG. 1. If the panel luminance adjustment signal is given as a digital signal, it is necessary to provide a voltage converter circuit for converting the digital luminance adjustment signal to a voltage to output the so generated voltage. For example, the panel luminance adjustment circuit 14 is constructed by a circuit shown e.g. in FIG. 18. It is noted that the video signal of FIG. 18 is a panel luminance adjustment signal, while the output signals $D_{Delb1}$ and $D_{Addb1}$ are the source potential $V_{PCON}$ of the PMOS power supply and the source potential $V_{NCON}$ of the NMOS power supply, respectively. It is also possible to read and control the information stored in a memory, not shown, from the outset.

The following Table 1 shows an example of designing specifications in which 64 grayscales have been divided into 14 intervals. This Table 1 shows a list of interval, grayscale (video signal), current values of gamma 2.2, $I_{OUT}$ (output current), $I_{OUT1}$ (first output current), $I_{Ref}$ (reference current) and $I_{OUT2}$ (second output current).

TABLE 1

Designing Example 1 Design Values

| INTERVAL | VIDEO SIGNAL | GAMMA 2.2(uA) | IOUT (uA) | IOUT1 (uA) | IRef (uA) | IOUT2 (uA) |
|---|---|---|---|---|---|---|
| 1 | 0 | 0.00 | 0.00 | 0.00 | 0.000 | 0.000 |
| | 1 | 0.01 | 0.01 | 0.01 | | 0.007 |
| 2 | 2 | 0.03 | 0.03 | 0.03 | | 0.032 |
| 3 | 3 | 0.08 | 0.08 | 0.08 | | 0.078 |
| 4 | 4 | 0.15 | 0.29 | 0.15 | | 0.146 |
| 5 | 5 | 0.24 | 0.38 | 0.24 | | 0.239 |
| 6 | 6 | 0.36 | 0.36 | 0.36 | | 0.357 |
| 7 | 7 | 0.50 | 0.50 | 0.00 | 0.185 | 0.501 |
| | 8 | 0.67 | 0.69 | 0.19 | | |
| | 9 | 0.87 | 0.87 | 0.37 | | |
| 8 | 10 | 1.10 | 1.10 | 0.00 | 0.286 | 1.098 |
| | 11 | 1.35 | 1.38 | 0.29 | | |
| | 12 | 1.64 | 1.67 | 0.57 | | |
| | 13 | 1.96 | 1.96 | 0.86 | | |
| 9 | 14 | 2.30 | 2.30 | 0.00 | 0.425 | 2.303 |
| | 15 | 2.68 | 2.73 | 0.43 | | |
| | 16 | 3.09 | 3.15 | 0.85 | | |
| | 17 | 3.53 | 3.58 | 1.28 | | |
| | 18 | 4.00 | 4.00 | 1.70 | | |

TABLE 1-continued

Designing Example 1 Design Values

| INTERVAL | VIDEO SIGNAL | GAMMA 2.2(uA) | IOUT (uA) | IOUT1 (uA) | IRef (uA) | IOUT2 (uA) |
|---|---|---|---|---|---|---|
| 10 | 19 | 4.51 | 4.51 | 0.00 | 0.606 | 4.509 |
| | 20 | 5.05 | 5.11 | 0.61 | | |
| | 21 | 5.62 | 5.72 | 1.21 | | |
| | 22 | 6.22 | 6.33 | 1.82 | | |
| | 23 | 6.86 | 6.93 | 2.42 | | |
| | 24 | 7.54 | 7.54 | 3.03 | | |
| 11 | 25 | 8.25 | 8.25 | 0.00 | 0.850 | 8.246 |
| | 26 | 8.99 | 9.10 | 0.85 | | |
| | 27 | 9.77 | 9.95 | 1.70 | | |
| | 28 | 10.58 | 10.80 | 2.55 | | |
| | 29 | 11.43 | 11.65 | 3.40 | | |
| | 30 | 12.32 | 12.50 | 4.25 | | |
| | 31 | 13.24 | 13.34 | 5.10 | | |
| | 32 | 14.19 | 14.19 | 5.95 | | |
| 12 | 33 | 15.19 | 15.19 | 0.00 | 1.181 | 15.189 |
| | 34 | 16.22 | 16.37 | 1.18 | | |
| | 35 | 17.29 | 17.55 | 2.38 | | |
| | 36 | 18.39 | 18.73 | 3.54 | | |
| | 37 | 19.54 | 19.91 | 4.72 | | |
| | 38 | 20.72 | 21.09 | 5.91 | | |
| | 39 | 21.93 | 22.28 | 7.09 | | |
| | 40 | 23.19 | 23.46 | 8.27 | | |
| | 41 | 24.49 | 24.64 | 9.45 | | |
| | 42 | 25.82 | 25.82 | 10.63 | | |
| 13 | 43 | 27.19 | 27.19 | 0.00 | 1.588 | 27.191 |
| | 44 | 28.60 | 28.76 | 1.57 | | |
| | 45 | 30.05 | 30.33 | 3.14 | | |
| | 46 | 31.54 | 31.90 | 4.70 | | |
| | 47 | 33.07 | 33.46 | 6.27 | | |
| | 48 | 34.64 | 35.03 | 7.84 | | |
| | 49 | 36.24 | 36.60 | 9.41 | | |
| | 50 | 37.89 | 38.17 | 10.98 | | |
| | 51 | 39.58 | 39.74 | 12.55 | | |
| | 52 | 41.30 | 41.30 | 14.11 | | |
| 14 | 53 | 43.07 | 43.07 | 0.00 | 1.993 | 43.072 |
| | 54 | 44.88 | 45.07 | 1.99 | | |
| | 55 | 46.73 | 47.06 | 3.99 | | |
| | 56 | 48.62 | 49.05 | 5.98 | | |
| | 57 | 50.55 | 51.04 | 7.97 | | |
| | 58 | 52.52 | 53.04 | 9.96 | | |
| | 59 | 54.53 | 55.03 | 11.96 | | |
| | 60 | 56.59 | 57.02 | 13.95 | | |
| | 61 | 58.68 | 59.01 | 15.94 | | |
| | 62 | 60.82 | 61.01 | 17.93 | | |
| | 63 | 63.00 | 63.00 | 19.83 | | |

In the above Table 1, gamma 2.2 is the value of the gamma curve and is given by gamma 2.2=IMAX×(video signal/number of grayscales)$^{2.2}$. It is noted that the IMAX of the output current IOUT is the maximum current value. In the present embodiment, gamma 2.2=63×(video signal/63 grayscales)$^{2.2}$. As for the gamma characteristic, the lower the grayscale, the stronger is its curvilinear property and, the higher the grayscale, the stronger is its linearity. That is, the second output current is used from the second current driver circuit 11 for compensation at the end of the interval of linear approximation.

Referring to the Table 1, the first output current $I_{OUT1}$ is varied responsive to 0 to 63 grayscales. The decoder 13 of FIG. 1 decodes the totality of bits (6 bits) of the video signal to control the on/off of the switches. The reference current $I_{Ref}$ is 0 μA for the interval 1 to 6, 0.185 μA for the interval 7 (video signal=7, 8 and 9), 0.286 μA for the interval 8 (video signal 10 to 13), 0.425 μA for the interval 9 (video signal 14 to 18), 0.606 μA for the interval 10 (video signal=19 to 24), 0.850 μA for the interval 11 (video signal 25 to 32), 1.181 μA for the interval 12 (video signal 33 to 42), 1.588 μA for the interval 13 (video signal 43 to 52), and 1.993 μA for the interval 14 (video signal 53 to 63). The second output current $I_{OUT2}$ is varied to 0 μA, 0.007 μA, 0.0032 μA, 0.078 μA, 0.146 μA, 0.239 μA and to 0.357 μA for the intervals 1, 2, 3, 4, 5 and 6, respectively, and is 0.501 μA, 1.098 μA, 2.303 μA, 4.509 μA, 8.246 μA, 15.189 μA, 27.191 μA and 43.072 μA for the intervals 7, 8, 9, 10, 11, 12, 13 and 14, respectively.

For example, in the interval 7, the reference current $I_{Ref}$ is the reference current for the video signal from 7 to 9. Hence, it is sufficient if the output current $I_{OUT}$ of 0.87 μA flows for the grayscale 9. Consequently, the reference current $I_{Ref}$ for the interval 7 is given by $I_{Ref}$f=(0.87−0.50)/2=0.185 μA (see Table 1).

The gamma 2.2 for the video signal=7 for the interval 7 is 0.50 μA. Since $I_{OUT1}$=0, $I_{OUT2}$ is 0.501 μA, and the output current $I_{OUT}$ of the driver circuit for a light-emitting element is given by $I_{OUT}=I_{OUT1}+I_{OUT2}$.

As for the interval 8 ff., the reference current $I_{Ref}$ and the second output current $I_{OUT2}$ of the second current driver circuit may be found in similar manner.

In the design specifications of the above Table 1, the 64 grayscales are partitioned into 14 intervals. The present invention is not limited to these specifications, such that the number of division or the interval width may, of course, be optionally set depending on the number of currents of the reference current source circuit 12, the number of current sources of the first and second current driver circuits 10, 11 or the number of grayscales.

The following Table 2 is a truth table for illustrating the configuration and the operation of the reference current source circuit 12 for the realization of the designing example of the above Table 1.

TABLE 2

Designing Example 1 Reference Current Source Circuit and Truth Table

| | | Reference Current Source Circuit | | | | | | | |
|---|---|---|---|---|---|---|---|---|---|
| INTERVAL | VIDEO SIGNAL | SWRef1 | SWRef2 | SWRef3 | SWRef4 | SWRef5 | SWRef6 | SWRef7 | SWRef8 |
| 1 | 0 | 0 | 0 | 0 | 0 | 0 | 0 | 0 | 0 |
| | 1 | | | | | | | | |
| 2 | 2 | | | | | | | | |
| 3 | 3 | | | | | | | | |
| 4 | 4 | | | | | | | | |
| 5 | 5 | | | | | | | | |
| 6 | 6 | | | | | | | | |
| 7 | 7 | 1 | | | | | | | |
| | 8 | | | | | | | | |
| | 9 | | | | | | | | |
| 8 | 10 | 0 | 1 | | | | | | |
| | 11 | | | | | | | | |
| | 12 | | | | | | | | |
| | 13 | | | | | | | | |
| 9 | 14 | | 0 | 1 | | | | | |
| | 15 | | | | | | | | |
| | 16 | | | | | | | | |
| | 17 | | | | | | | | |
| | 18 | | | | | | | | |
| 10 | 19 | | | 0 | 1 | | | | |
| | 20 | | | | | | | | |
| | 21 | | | | | | | | |
| | 22 | | | | | | | | |
| | 23 | | | | | | | | |
| | 24 | | | | | | | | |
| 11 | 25 | | | | 0 | 1 | | | |
| | 26 | | | | | | | | |
| | 27 | | | | | | | | |
| | 28 | | | | | | | | |
| | 29 | | | | | | | | |
| | 30 | | | | | | | | |
| | 31 | | | | | | | | |
| | 32 | | | | | | | | |
| 12 | 33 | | | | | 0 | 1 | | |
| | 34 | | | | | | | | |
| | 35 | | | | | | | | |
| | 36 | | | | | | | | |
| | 37 | | | | | | | | |
| | 38 | | | | | | | | |
| | 39 | | | | | | | | |
| | 40 | | | | | | | | |
| | 41 | | | | | | | | |
| | 42 | | | | | | | | |
| 13 | 43 | | | | | | 0 | 1 | |
| | 44 | | | | | | | | |
| | 45 | | | | | | | | |
| | 46 | | | | | | | | |
| | 47 | | | | | | | | |
| | 48 | | | | | | | | |
| | 49 | | | | | | | | |
| | 50 | | | | | | | | |
| | 51 | | | | | | | | |
| | 52 | | | | | | | | |
| 14 | 53 | | | | | | | 0 | 1 |
| | 54 | | | | | | | | |
| | 55 | | | | | | | | |
| | 56 | | | | | | | | |
| | 57 | | | | | | | | |
| | 58 | | | | | | | | |
| | 59 | | | | | | | | |
| | 60 | | | | | | | | |
| | 61 | | | | | | | | |
| | 62 | | | | | | | | |
| | 63 | | | | | | | | |

In the switches SWRef1 to SWRefn of the reference current source circuit 12 of FIG. 8, 'n' is set to 8, that is, eight switches are provided, and the switches SWRef1 to SWREf8 are turned on for the intervals 7 to 14.

The following Table 3 is a truth table for illustrating the configuration and the operation of the first current driver circuit 10 for the realization of the designing example of the above Table 1.

TABLE 3

Designing Example 1 Current Driver Circuit 10 Truth Table

| | | Current Driver Circuit 10 | | | | | | | | | |
|---|---|---|---|---|---|---|---|---|---|---|---|
| INTERVAL | VIDEO SIGNAL | SW01 | SW02 | SW03 | SW04 | SW05 | SW06 | SW07 | SW08 | SW09 | SW10 |
| 1 | 0 | 0 | 0 | 0 | 0 | 0 | 0 | 0 | 0 | 0 | 0 |
| | 1 | | | | | | | | | | |
| 2 | 2 | | | | | | | | | | |
| 3 | 3 | | | | | | | | | | |
| 4 | 4 | | | | | | | | | | |
| 5 | 5 | | | | | | | | | | |
| 6 | 6 | | | | | | | | | | |
| 7 | 7 | | | | | | | | | | |
| | 8 | 1 | | | | | | | | | |
| | 9 | | 1 | | | | | | | | |
| 8 | 10 | 0 | 0 | | | | | | | | |
| | 11 | 1 | | | | | | | | | |
| | 12 | | 1 | | | | | | | | |
| | 13 | | | 1 | | | | | | | |
| 9 | 14 | 0 | 0 | 0 | | | | | | | |
| | 15 | 1 | | | | | | | | | |
| | 16 | | 1 | | | | | | | | |
| | 17 | | | 1 | | | | | | | |
| | 18 | | | | 1 | | | | | | |
| 10 | 19 | 0 | 0 | 0 | 0 | | | | | | |
| | 20 | 1 | | | | | | | | | |
| | 21 | | 1 | | | | | | | | |
| | 22 | | | 1 | | | | | | | |
| | 23 | | | | 1 | | | | | | |
| | 24 | | | | | 1 | | | | | |
| 11 | 25 | 0 | 0 | 0 | 0 | 0 | | | | | |
| | 26 | 1 | | | | | | | | | |
| | 27 | | 1 | | | | | | | | |
| | 28 | | | 1 | | | | | | | |
| | 29 | | | | 1 | | | | | | |
| | 30 | | | | | 1 | | | | | |
| | 31 | | | | | | 1 | | | | |
| | 32 | | | | | | | 1 | | | |
| 12 | 33 | 0 | 0 | 0 | 0 | 0 | 0 | 0 | | | |
| | 34 | 1 | | | | | | | | | |
| | 35 | | 1 | | | | | | | | |
| | 36 | | | 1 | | | | | | | |
| | 37 | | | | 1 | | | | | | |
| | 38 | | | | | 1 | | | | | |
| | 39 | | | | | | 1 | | | | |
| | 40 | | | | | | | 1 | | | |
| | 41 | | | | | | | | 1 | | |
| | 42 | | | | | | | | | 1 | |
| 13 | 43 | 0 | 0 | 0 | 0 | 0 | 0 | 0 | 0 | 0 | |
| | 44 | 1 | | | | | | | | | |
| | 45 | | 1 | | | | | | | | |
| | 46 | | | 1 | | | | | | | |
| | 47 | | | | 1 | | | | | | |
| | 48 | | | | | 1 | | | | | |
| | 49 | | | | | | 1 | | | | |
| | 50 | | | | | | | 1 | | | |
| | 51 | | | | | | | | 1 | | |
| | 52 | | | | | | | | | 1 | |
| 14 | 53 | 0 | 0 | 0 | 0 | 0 | 0 | 0 | 0 | 0 | |
| | 54 | 1 | | | | | | | | | |
| | 55 | | 1 | | | | | | | | |
| | 56 | | | 1 | | | | | | | |
| | 57 | | | | 1 | | | | | | |
| | 58 | | | | | 1 | | | | | |
| | 59 | | | | | | 1 | | | | |
| | 60 | | | | | | | 1 | | | |
| | 61 | | | | | | | | 1 | | |
| | 62 | | | | | | | | | 1 | |
| | 63 | | | | | | | | | | 1 |

The switches Sw1 to Swk of the first current driver circuit 10 of FIG. 1 are 10 switches SW01 to SW10. In the example shown in Table 3, the current source transistors M1 to M10 are not weighted. The decoder 13 is supplied with 6-bit video signal to control the on/off of the switches SW0 to SW10, for the values 1 to 63 of the video signal, as shown in Table 3. In case of weighting of the current source transistors M1 to M10, the configuration is of 4 bits.

The following Table 4 is a truth table for illustrating the configuration and the operation of the second current driver circuit 11 for the realization of the designing example of the above Table 1.

TABLE 4

Designing Example 1 Current Driver Circuit 11 Truth Table

| | | Current Driver Circuit 11 | | | | | | | | | | | | | |
|---|---|---|---|---|---|---|---|---|---|---|---|---|---|---|---|
| INTERVAL | VIDEO SIGNAL | SW1 1 | SW2 1 | SW3 1 | SW4 1 | SW5 1 | SW6 1 | SW7 1 | SW8 1 | SW9 1 | SW10 1 | SW11 1 | SW12 1 | SW13 1 | SW14 1 |
| 1 | 0 | 0 | 0 | 0 | 0 | 0 | 0 | 0 | 0 | 0 | 0 | 0 | 0 | 0 | 0 |
| | 1 | 1 | | | | | | | | | | | | | |
| 2 | 2 | | 1 | | | | | | | | | | | | |
| 3 | 3 | | | 1 | | | | | | | | | | | |
| 4 | 4 | | | | 1 | | | | | | | | | | |
| 5 | 5 | | | | | 1 | | | | | | | | | |
| 6 | 6 | | | | | | 1 | | | | | | | | |
| 7 | 7 | | | | | | | 1 | | | | | | | |
| | 8 | | | | | | | | | | | | | | |
| | 9 | | | | | | | | | | | | | | |
| 8 | 10 | | | | | | | | 1 | | | | | | |
| | 11 | | | | | | | | | | | | | | |
| | 12 | | | | | | | | | | | | | | |
| | 13 | | | | | | | | | | | | | | |
| 9 | 14 | | | | | | | | | 1 | | | | | |
| | 15 | | | | | | | | | | | | | | |
| | 16 | | | | | | | | | | | | | | |
| | 17 | | | | | | | | | | | | | | |
| | 18 | | | | | | | | | | | | | | |
| 10 | 19 | | | | | | | | | | 1 | | | | |
| | 20 | | | | | | | | | | | | | | |
| | 21 | | | | | | | | | | | | | | |
| | 22 | | | | | | | | | | | | | | |
| | 23 | | | | | | | | | | | | | | |
| | 24 | | | | | | | | | | | | | | |
| 11 | 25 | | | | | | | | | | | 1 | | | |
| | 26 | | | | | | | | | | | | | | |
| | 27 | | | | | | | | | | | | | | |
| | 28 | | | | | | | | | | | | | | |
| | 29 | | | | | | | | | | | | | | |
| | 30 | | | | | | | | | | | | | | |
| | 31 | | | | | | | | | | | | | | |
| | 32 | | | | | | | | | | | | | | |
| 12 | 33 | | | | | | | | | | | | 1 | | |
| | 34 | | | | | | | | | | | | | | |
| | 35 | | | | | | | | | | | | | | |
| | 36 | | | | | | | | | | | | | | |
| | 37 | | | | | | | | | | | | | | |
| | 38 | | | | | | | | | | | | | | |
| | 39 | | | | | | | | | | | | | | |
| | 40 | | | | | | | | | | | | | | |
| | 41 | | | | | | | | | | | | | | |
| | 42 | | | | | | | | | | | | | | |
| 13 | 43 | | | | | | | | | | | | | 1 | |
| | 44 | | | | | | | | | | | | | | |
| | 45 | | | | | | | | | | | | | | |
| | 46 | | | | | | | | | | | | | | |
| | 47 | | | | | | | | | | | | | | |
| | 48 | | | | | | | | | | | | | | |
| | 49 | | | | | | | | | | | | | | |
| | 50 | | | | | | | | | | | | | | |
| | 51 | | | | | | | | | | | | | | |
| | 52 | | | | | | | | | | | | | | |
| 14 | 53 | | | | | | | | | | | | | | 1 |
| | 54 | | | | | | | | | | | | | | |
| | 55 | | | | | | | | | | | | | | |
| | 56 | | | | | | | | | | | | | | |

TABLE 4-continued

Designing Example 1 Current Driver Circuit 11 Truth Table

| | | Current Driver Circuit 11 | | | | | | | | | | | | | |
|---|---|---|---|---|---|---|---|---|---|---|---|---|---|---|---|
| INTERVAL | VIDEO SIGNAL | SW1 1 | SW2 1 | SW3 1 | SW4 1 | SW5 1 | SW6 1 | SW7 1 | SW8 1 | SW9 1 | SW10 1 | SW11 1 | SW12 1 | SW13 1 | SW14 1 |
| | 57 | | | | | | | | | | | | | | |
| | 58 | | | | | | | | | | | | | | |
| | 59 | | | | | | | | | | | | | | |
| | 60 | | | | | | | | | | | | | | |
| | 61 | | | | | | | | | | | | | | |
| | 62 | | | | | | | | | | | | | | |
| | 63 | | | | | | | | | | | | | | |

The switches SWAdd1 to SWAdd3 of the second current driver circuit 11 of FIG. 15 are 14 switches of SW11 to SW141. The decoder 111 performs on/off control of the switches SW11, SW21, SW31, . . . , SW141, for the video signal 1 to 63, as shown in Table 4.

The following Table 5 shows another example of the designing specifications in case 63 grayscales are partitioned into 14 intervals. This Table 5 shows a list of the interval, grayscale (video signal), current values of gamma 2.2, $I_{OUT}$ (output current), $I_{OUT1}$ (first output current), reference current $I_{Ref}$ and $I_{OUT2}$ (second output current).

TABLE 5

Designing Example 2 Design Values

| INTERVAL | VIDEO SIGNAL | GAMMA 2.2(uA) | IOUT (uA) | IOUT1 (uA) | IRef (uA) | IOUT2 (uA) |
|---|---|---|---|---|---|---|
| 1 | 0 | 0.00 | 0.00 | 0.00 | 0.000 | 0.000 |
| | 1 | 0.01 | 0.01 | 0.01 | | 0.007 |
| 2 | 2 | 0.03 | 0.03 | 0.03 | | 0.032 |
| 3 | 3 | 0.08 | 0.08 | 0.08 | | 0.078 |
| 4 | 4 | 0.15 | 0.29 | 0.15 | | 0.146 |
| 5 | 5 | 0.24 | 0.39 | 0.24 | | 0.239 |
| 6 | 6 | 0.36 | 0.36 | 0.36 | | 0.357 |
| 7 | 7 | 0.50 | 0.50 | 0.00 | 0.185 | 0.501 |
| | 8 | 0.67 | 0.69 | 0.19 | | |
| | 9 | 0.87 | 0.87 | 0.37 | | |
| 8 | 10 | 1.10 | 1.10 | 0.00 | 0.286 | 1.098 |
| | 11 | 1.35 | 1.38 | 0.29 | | |
| | 12 | 1.64 | 1.67 | 0.57 | | |
| | 13 | 1.96 | 1.96 | 0.86 | | |
| 9 | 14 | 2.30 | 2.30 | 0.00 | 0.425 | 2.303 |
| | 15 | 2.68 | 2.73 | 0.43 | | |
| | 16 | 3.09 | 3.15 | 0.85 | | |
| | 17 | 3.53 | 3.58 | 1.28 | | |
| | 18 | 4.00 | 4.00 | 0.00 | | 1.700 |
| 10 | 19 | 4.51 | 4.51 | 0.00 | 0.606 | 4.509 |
| | 20 | 5.05 | 5.11 | 0.61 | | |
| | 21 | 5.62 | 5.72 | 1.21 | | |
| | 22 | 6.22 | 6.33 | 1.82 | | |
| | 23 | 6.86 | 6.93 | 0.00 | | 2.423 |
| | 24 | 7.54 | 7.54 | 0.61 | | |
| 11 | 25 | 8.25 | 8.25 | 0.00 | 0.850 | 8.246 |
| | 26 | 8.99 | 9.10 | 0.85 | | |
| | 27 | 9.77 | 9.95 | 1.70 | | |
| | 28 | 10.58 | 10.80 | 2.55 | | |
| | 29 | 11.43 | 11.65 | 0.00 | | 3.399 |
| | 30 | 12.32 | 12.50 | 0.85 | | |
| | 31 | 13.24 | 13.34 | 1.70 | | |
| | 32 | 14.19 | 14.19 | 2.55 | | |
| 12 | 33 | 15.19 | 15.19 | 0.00 | 1.181 | 15.189 |
| | 34 | 16.22 | 16.37 | 1.18 | | |
| | 35 | 17.29 | 17.55 | 2.36 | | |
| | 36 | 18.39 | 18.73 | 3.54 | | |
| | 37 | 19.54 | 19.91 | 0.00 | | 4.725 |
| | 38 | 20.72 | 21.09 | 1.18 | | |
| | 39 | 21.93 | 22.28 | 2.36 | | |
| | 40 | 23.19 | 23.46 | 3.54 | | |
| | 41 | 24.49 | 24.64 | 0.00 | | 4.725 |
| | 42 | 25.82 | 25.82 | 1.18 | | |
| 13 | 43 | 27.19 | 27.19 | 0.00 | 1.568 | 27.191 |
| | 44 | 28.60 | 28.76 | 1.57 | | |

TABLE 5-continued

| Designing Example 2 Design Values | | | | | | |
|---|---|---|---|---|---|---|
| INTERVAL | VIDEO SIGNAL | GAMMA 2.2(uA) | IOUT (uA) | IOUT1 (uA) | IRef (uA) | IOUT2 (uA) |
| | 45 | 30.05 | 30.33 | 3.14 | | |
| | 46 | 31.54 | 31.90 | 4.70 | | |
| | 47 | 33.07 | 33.46 | 0.00 | | 6.273 |
| | 48 | 34.64 | 35.03 | 1.57 | | |
| | 49 | 36.24 | 36.60 | 3.14 | | |
| | 50 | 37.89 | 38.17 | 4.70 | | |
| | 51 | 39.58 | 39.74 | 0.00 | | 6.273 |
| | 52 | 41.30 | 41.30 | 1.57 | | |
| 14 | 53 | 43.07 | 43.07 | 0.00 | 1.993 | 43.072 |
| | 54 | 44.88 | 45.07 | 1.99 | | |
| | 55 | 46.73 | 47.06 | 3.99 | | |
| | 56 | 48.62 | 49.05 | 5.98 | | |
| | 57 | 50.55 | 51.04 | 0.00 | | 7.971 |
| | 58 | 52.52 | 53.04 | 1.99 | | |
| | 59 | 54.53 | 55.03 | 3.99 | | |
| | 60 | 56.59 | 57.02 | 5.98 | | |
| | 61 | 58.68 | 59.01 | 0.00 | | 7.971 |
| | 62 | 60.82 | 61.01 | 1.99 | | |
| | 63 | 63.00 | 63.00 | 3.99 | | |

In the above Table 5, gamma 2.2 is the value of the gamma curve and is given by gamma 2.2=IMAX×(video signal/number of grayscales)$^{2.2}$. It is noted that the IMAX of the output current $I_{OUT}$ is the maximum current value. In Table 5, the reference current $I_{Ref}$ for the intervals 1 to 14 is the same as in Table 1 above. In the example of Table 5, the first output current $I_{OUT1}$ assumes ten different values at the maximum in each interval. The decoder 13 of the first current driver circuit 10 is of the 3-bit configuration (with there being current source weighting), and compensation is by the second output current from the second current driver circuit 11 at an end of each interval. That is, the carry current of the first current driver circuit 10 is taken charge of by the second current driver circuit 11. Table 6 is a truth table for illustrating the operation of the first current driver circuit 10 for realization of the designing example of Table 5.

TABLE 6

| Designing Example 2 Current Source Driver Circuit 10 Truth Table | | | | |
|---|---|---|---|---|
| | | Current Source Driver Circuit 10 | | |
| INTERVAL | VIDEO SIGNAL | SW01 | SW02 | SW03 |
| 1 | 0 | 0 | 0 | 0 |
| | 1 | | | |
| 2 | 2 | | | |
| 3 | 3 | | | |
| 4 | 4 | | | |
| 5 | 5 | | | |
| 6 | 6 | | | |
| 7 | 7 | 0 | 0 | 0 |
| | 8 | 1 | | |
| | 9 | | 1 | |
| 8 | 10 | 0 | 0 | 0 |
| | 11 | 1 | | |
| | 12 | | 1 | |
| | 13 | | | 1 |
| 9 | 14 | 0 | 0 | 0 |
| | 15 | 1 | | |
| | 16 | | 1 | |
| | 17 | | | 1 |
| | 18 | 0 | 0 | 0 |
| 10 | 19 | 0 | 0 | 0 |
| | 20 | 1 | | |
| | 21 | | 1 | |

TABLE 6-continued

| Designing Example 2 Current Source Driver Circuit 10 Truth Table | | | | |
|---|---|---|---|---|
| | | Current Source Driver Circuit 10 | | |
| INTERVAL | VIDEO SIGNAL | SW01 | SW02 | SW03 |
| | 22 | | | 1 |
| | 23 | 0 | 0 | 0 |
| | 24 | 1 | | |
| 11 | 25 | 0 | 0 | 0 |
| | 26 | 1 | | |
| | 27 | | 1 | |
| | 28 | | | 1 |
| | 29 | 0 | 0 | 0 |
| | 30 | 1 | | |
| | 31 | | 1 | |
| | 32 | | | 1 |
| 12 | 33 | 0 | 0 | 0 |
| | 34 | 1 | | |
| | 35 | | 1 | |
| | 36 | | | 1 |
| | 37 | 0 | 0 | 0 |
| | 38 | 1 | | |
| | 39 | | 1 | |
| | 40 | | | 1 |
| | 41 | 0 | 0 | 0 |
| | 42 | 1 | | |
| 13 | 43 | 0 | 0 | 0 |
| | 44 | 1 | | |
| | 45 | | 1 | |
| | 46 | | | 1 |
| | 47 | 0 | 0 | 0 |
| | 48 | 1 | | |
| | 49 | | 1 | |
| | 50 | | | 1 |
| | 51 | 0 | 0 | 0 |
| | 52 | 1 | | |
| 14 | 53 | 0 | 0 | 0 |
| | 54 | 1 | | |
| | 55 | | 1 | |
| | 56 | | | 1 |
| | 57 | 0 | 0 | 0 |
| | 58 | 1 | | |

TABLE 6-continued

| Designing Example 2 Current Source Driver Circuit 10 Truth Table | | | | |
|---|---|---|---|---|
| | | Current Source Driver Circuit 10 | | |
| INTERVAL | VIDEO SIGNAL | SW01 | SW02 | SW03 |
| | 59 | | 1 | |
| | 60 | | | 1 |
| | 61 | 0 | 0 | 0 |
| | 62 | 1 | | |
| | 63 | | 1 | |

In Table 6, the switches SW01, SW02 and SW03 of the first current driver circuit 10 correspond to the switches SW1, SW2 and SW3 (k=3), respectively. The current source transistors M1, M2 and M3 (k=3) are weighted with $2^0$, $2^1$, $2^2$, respectively.

The following Table 7 is a truth table for illustrating the configuration and the operation of the second current driver circuit 11 for the realization of the designing example of the above Table 5. In the Table 7, 0 and 1 denote off and on, respectively.

TABLE 7

| Designing Example 2 Current Driver Circuit 11 Truth Table 1 | | | | | | | | | | | | | |
|---|---|---|---|---|---|---|---|---|---|---|---|---|---|
| | | Current Driver Circuit 11 | | | | | | | | | | | |
| INTERVAL | VIDEO SIGNAL | SW1 1 | SW2 1 | SW3 1 | SW4 1 | SW5 1 | SW6 1 | SW7 1 | SW8 1 | SW9 1 | SW9 2 | SW10 1 | SW10 2 |
| 1 | 0 | 0 | 0 | 0 | 0 | 0 | 0 | 0 | 0 | 0 | 0 | 0 | 0 |
| | 1 | 1 | | | | | | | | | | | |
| 2 | 2 | | 1 | | | | | | | | | | |
| 3 | 3 | | | 1 | | | | | | | | | |
| 4 | 4 | | | | 1 | | | | | | | | |
| 5 | 5 | | | | | 1 | | | | | | | |
| 6 | 6 | | | | | | 1 | | | | | | |
| 7 | 7 | | | | | | | 1 | | | | | |
| | 8 | | | | | | | | | | | | |
| | 9 | | | | | | | | | | | | |
| 8 | 10 | | | | | | | | 1 | | | | |
| | 11 | | | | | | | | | | | | |
| | 12 | | | | | | | | | | | | |
| | 13 | | | | | | | | | | | | |
| 9 | 14 | | | | | | | | | 1 | | | |
| | 15 | | | | | | | | | | | | |
| | 16 | | | | | | | | | | | | |
| | 17 | | | | | | | | | | | | |
| | 18 | | | | | | | | | | 1 | | |
| 10 | 19 | | | | | | | | | | | 1 | |
| | 20 | | | | | | | | | | | | |
| | 21 | | | | | | | | | | | | |
| | 22 | | | | | | | | | | | | |
| | 23 | | | | | | | | | | | | 1 |
| | 24 | | | | | | | | | | | | |
| 11 | 25 | | | | | | | | | | | | |
| | 26 | | | | | | | | | | | | |
| | 27 | | | | | | | | | | | | |
| | 28 | | | | | | | | | | | | |
| | 29 | | | | | | | | | | | | |
| | 30 | | | | | | | | | | | | |
| | 31 | | | | | | | | | | | | |
| | 32 | | | | | | | | | | | | |
| 12 | 33 | | | | | | | | | | | | |
| | 34 | | | | | | | | | | | | |
| | 35 | | | | | | | | | | | | |
| | 36 | | | | | | | | | | | | |
| | 37 | | | | | | | | | | | | |
| | 38 | | | | | | | | | | | | |
| | 39 | | | | | | | | | | | | |
| | 40 | | | | | | | | | | | | |
| | 41 | | | | | | | | | | | | |
| | 42 | | | | | | | | | | | | |
| 13 | 43 | | | | | | | | | | | | |
| | 44 | | | | | | | | | | | | |
| | 45 | | | | | | | | | | | | |
| | 46 | | | | | | | | | | | | |
| | 47 | | | | | | | | | | | | |
| | 48 | | | | | | | | | | | | |
| | 49 | | | | | | | | | | | | |
| | 50 | | | | | | | | | | | | |
| | 51 | | | | | | | | | | | | |
| | 52 | | | | | | | | | | | | |

TABLE 7-continued

| | | Designing Example 2 Current Driver Circuit 11 Truth Table 1 | | | | | | | | | | | |
|---|---|---|---|---|---|---|---|---|---|---|---|---|---|
| | | Current Driver Circuit 11 | | | | | | | | | | | |
| INTERVAL | VIDEO SIGNAL | SW1 1 | SW2 1 | SW3 1 | SW4 1 | SW5 1 | SW6 1 | SW7 1 | SW8 1 | SW9 1 | SW9 2 | SW10 1 | SW10 2 |
| 14 | 53 | | | | | | | | | | | | |
| | 54 | | | | | | | | | | | | |
| | 55 | | | | | | | | | | | | |
| | 56 | | | | | | | | | | | | |
| | 57 | | | | | | | | | | | | |
| | 58 | | | | | | | | | | | | |
| | 59 | | | | | | | | | | | | |
| | 60 | | | | | | | | | | | | |
| | 61 | | | | | | | | | | | | |
| | 62 | | | | | | | | | | | | |
| | 63 | | | | | | | | | | | | |

The switches SWAdd1 to SWAdd3 of the second current driver circuit 11 of FIG. 15 are 12 switches of SW11, SW21, SW31, SW41, SW51, SW61, SW71, SW81, SW91, SW101 and SW102. The decoder 111 is supplied with and decodes 6-bit video signal and on/off controls the switches SW11, . . . , SW102, as shown in Table 7.

The following Table 8 is a truth table for illustrating the configuration and the operation of a modified configuration of the second current driver circuit 11 for the realization of the designing example of the above Table 5. In the Table 7, 0 and 1 denote off and on, respectively.

TABLE 8

| | | Designing Example 2 Current Driver Circuit 11 Truth Table 2 | | | | | | | | | | |
|---|---|---|---|---|---|---|---|---|---|---|---|---|
| | | Current Driver Circuit 11 | | | | | | | | | | |
| INTERVAL | VIDEO SIGNAL | SW11 1 | SW11 2 | SW12 1 | SW12 2 | SW12 3 | SW13 1 | SW13 2 | SW13 3 | SW14 1 | SW14 2 | SW14 3 |
| 1 | 0 | 0 | 0 | 0 | 0 | 0 | 0 | 0 | 0 | 0 | 0 | 0 |
| | 1 | | | | | | | | | | | |
| 2 | 2 | | | | | | | | | | | |
| 3 | 3 | | | | | | | | | | | |
| 4 | 4 | | | | | | | | | | | |
| 5 | 5 | | | | | | | | | | | |
| 6 | 6 | | | | | | | | | | | |
| 7 | 7 | | | | | | | | | | | |
| | 8 | | | | | | | | | | | |
| | 9 | | | | | | | | | | | |
| 8 | 10 | | | | | | | | | | | |
| | 11 | | | | | | | | | | | |
| | 12 | | | | | | | | | | | |
| | 13 | | | | | | | | | | | |
| 9 | 14 | | | | | | | | | | | |
| | 15 | | | | | | | | | | | |
| | 16 | | | | | | | | | | | |
| | 17 | | | | | | | | | | | |
| | 18 | | | | | | | | | | | |
| 10 | 19 | | | | | | | | | | | |
| | 20 | | | | | | | | | | | |
| | 21 | | | | | | | | | | | |
| | 22 | | | | | | | | | | | |
| | 23 | | | | | | | | | | | |
| | 24 | | | | | | | | | | | |
| 11 | 25 | 1 | | | | | | | | | | |
| | 26 | | | | | | | | | | | |
| | 27 | | | | | | | | | | | |
| | 28 | | | | | | | | | | | |
| | 29 | | 1 | | | | | | | | | |
| | 30 | | | | | | | | | | | |
| | 31 | | | | | | | | | | | |
| | 32 | | | | | | | | | | | |
| 12 | 33 | | | 1 | | | | | | | | |
| | 34 | | | | | | | | | | | |
| | 35 | | | | | | | | | | | |
| | 36 | | | | | | | | | | | |
| | 37 | | | | 1 | | | | | | | |
| | 38 | | | | | | | | | | | |
| | 39 | | | | | | | | | | | |

TABLE 8-continued

Designing Example 2 Current Driver Circuit 11 Truth Table 2

| | | Current Driver Circuit 11 | | | | | | | | | | |
|---|---|---|---|---|---|---|---|---|---|---|---|---|
| INTERVAL | VIDEO SIGNAL | SW11 1 | SW11 2 | SW12 1 | SW12 2 | SW12 3 | SW13 1 | SW13 2 | SW13 3 | SW14 1 | SW14 2 | SW14 3 |
| | 40 | | | | | | | | | | | |
| | 41 | | | | | 1 | | | | | | |
| | 42 | | | | | | | | | | | |
| 13 | 43 | | | | | | 1 | | | | | |
| | 44 | | | | | | | | | | | |
| | 45 | | | | | | | | | | | |
| | 46 | | | | | | | | | | | |
| | 47 | | | | | | | 1 | | | | |
| | 48 | | | | | | | | | | | |
| | 49 | | | | | | | | | | | |
| | 50 | | | | | | | | | | | |
| | 51 | | | | | | | | 1 | | | |
| | 52 | | | | | | | | | | | |
| 14 | 53 | | | | | | | | | 1 | | |
| | 54 | | | | | | | | | | | |
| | 55 | | | | | | | | | | | |
| | 56 | | | | | | | | | | | |
| | 57 | | | | | | | | | | 1 | |
| | 58 | | | | | | | | | | | |
| | 59 | | | | | | | | | | | |
| | 60 | | | | | | | | | | | |
| | 61 | | | | | | | | | | | 1 |
| | 62 | | | | | | | | | | | |
| | 63 | | | | | | | | | | | |

Figure 22:
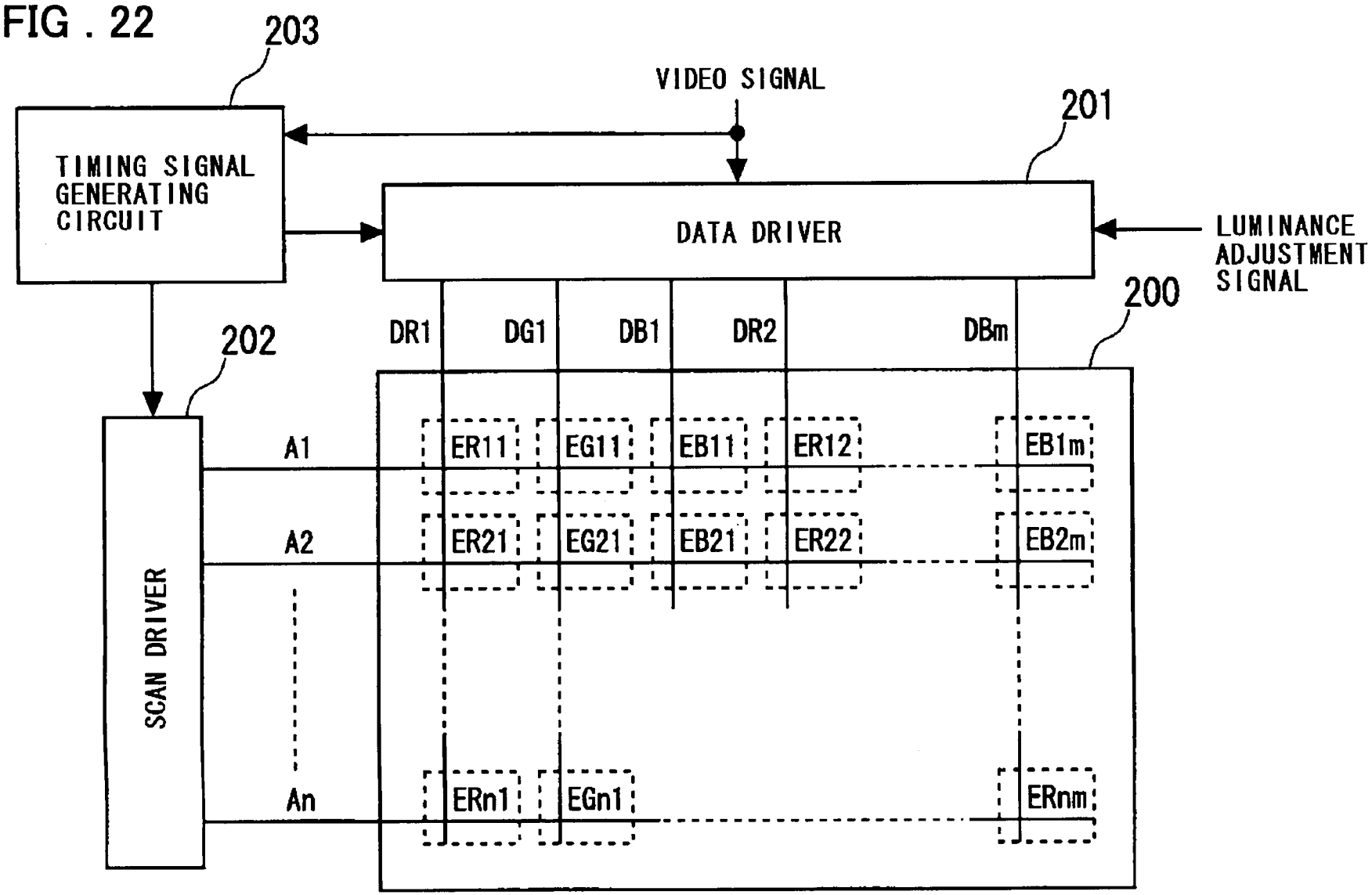
FIG. 22 is a diagram illustrating a configuration of a display driving device according to an embodiment of the present invention.

A display device according to the present invention will be described next. FIG. 22 is a diagram illustrating an implementation in which a display driver according to the present invention is applied to a display device of active-matrix drive type. The display panel 200 includes light-emitting units ER, EG and EB for emitting red, green and blue light, respectively, arrayed at the intersections of a plurality (n-number) of horizontal scan lines A1 to An of one screen and m-number of red drive data lines DR1 to DRm, m-number of green drive data lines DG1 to DGm and m-number of blue drive data lines DB1 to DBm disposed so as to intersect each of the scan lines. The light-emitting units comprise electroluminescent elements, by way of example.

Responsive to a video signal input thereto, a timing signal generating circuit 203 generates a timing signal, which indicates the application timing of scan pulses applied sequentially to the scan lines A1 to An, and supplies the signal to a scan driver 202.

The scan driver 202 supplies the scan lines A1 to An of the display panel with scan pulses sequentially responsive to the timing signal supplied from the timing signal generating circuit 203.

The data driver 201 generates a current that corresponds to the logic level of the video signal and drives the drive data lines DR1 to DRm, DG1 to DGm and DB1 to DBm.

Figure 23:
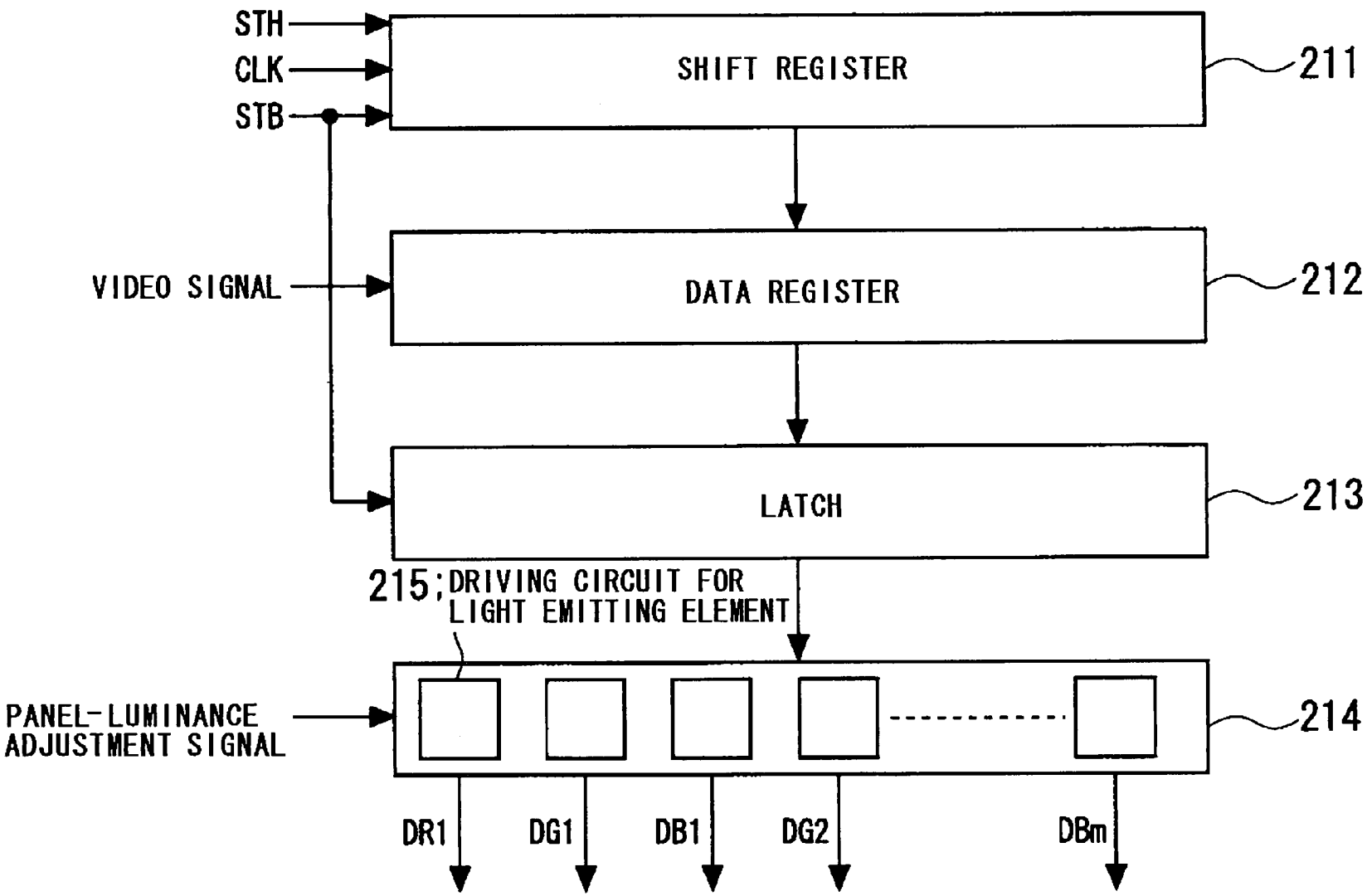
FIG. 23 is a diagram illustrating a configuration of a data driver of FIG. 22.

FIG. 23 is a block diagram illustrating the structure of the data driver 201 shown in FIG. 22. As shown in FIG. 23, the data driver 201 has a shift register 211, a data register 212, a latch circuit 213 and an output circuit 214. Signals input to the shift register 211, etc., are a synchronising clock signal CLK, a start-pulse signal STH and a latch signal (strobe signal) STB supplied by the timing signal generating circuit 203. The video signal is input to the data register 212 and the panel-luminance adjustment signal is input to the output circuit 214. The output circuit 214 has a plurality (m×3) of driver circuits 215, which are for driving light-emitting elements, having output terminals connected to respective ones of m-number of red, green and blue drive data lines. Each driver circuit 215 is constituted by the light-emitting-element driver circuit embodying the present invention described above with reference to FIG. 1, etc.

The shift register 211 transfers the strobe signal STB, which is supplied by the start pulse STH constituting the start timing of the horizontal scanning interval, in accordance with the clock signal CLK and supplies the strobe signal successively to the data register 212.

The data register 212 samples the video signal in response to the strobe signal from the shift register 211 and transfers the video signal to the latch circuit 213.

The latch circuit 213 latches a plurality of video signals, which have been latched by the data register 212, all at once in response to the strobe signal STB and supplies the latched signals to the corresponding element driver circuits 215. The video signal supplied to the input terminal 1 in FIG. 1 is the signal latched by the latch circuit 213. The element driver circuit 215 also performs a gamma correction of gamma value 2.2, etc. Further, the element driver circuit 215 receives an input of the panel-luminance adjustment signal and performs an overall luminance adjustment of the display panel 200.

The light-emitting units ER, EG and EB for emitting red, green and blue light, respectively, are not identical with one another in terms of the relationship between the current that flows and luminance. Accordingly, in the present embodiment, the current supplied from each of the element driver circuits 215 is adjusted beforehand on a per-color basis, whereby panel luminance can be made uniform. Specifically, in the present embodiment, the element driver circuits 215 are controlled individually depending upon the color of the light-emitting element, whereby the luminance of the panel is made uniform. Since each element driver circuit 215 performs a gamma correction internally of the driver circuit, it is unnecessary to provide a gamma correction circuit and chip area is reduced in a case where integration is performed. The circuit therefore is well suited for application to a semiconductor device.

The driver circuit for a light-emitting element illustrated in FIG. 1 can be construed as having the structure of a current-output-type digital-to-analog converter (DAC) circuit for performing a non-linear conversion such as a gamma correction. That is, a DA converter, supplied with a digital input signal and outputting an output current converted from and corresponding to the digital input signal, includes the first current driver circuit 10, second current driver circuit 11 and the reference current source circuit 12. The first current driver circuit includes plural current sources, output current values of which are determined based on the reference current $I_{Ref}$, and a switch circuit for on/off controlling the current path between the plural current sources and current output terminals, based on the digital input signal, to output a first output current $I_{OUT1}$ conforming to the digital input signal. The second current driver circuit outputs a second output current $I_{OUT2}$ conforming to the digital input signal, whilst the reference current source circuit, including a reference current source, generates the reference current $I_{Ref}$, exercises variable control based on the digital input signal. The sum current that is obtained on combining the first output current $I_{OUT1}$ and the second output current $I_{OUT2}$ from the first and second current driver circuits is output as the output current $I_{OUT}$, while the amount of change in the output current $I_{OUT}$ (quantization step) corresponding to the change in the unit quantity of the digital input signal (1 LSB) is varied responsive to the value (interval) of the digital input signal. Of course, it may be so arranged that current that is output from the converter circuit is converted to a voltage and the driver circuit outputs a voltage conforming to the input voltage, whereby a voltage-drive-type display element such as a liquid crystal element is driven by a data signal that has been gamma-corrected in accordance with the grayscale. The input/output characteristic between the input signal and the output current can be set to a gamma characteristic having two inflection points (points where the polarity of curvature reverses). It is also possible with the present invention to set the input/output characteristic between the input signal and the output current to a desired characteristic depending on the number of the current sources of the first and second current driver circuits and the reference current source circuit, the setting of the current values thereof and on the manner of bit allocation of the input signal.

Although the present invention has so far been explained with reference to preferred embodiments thereof, it is to be noted that these embodiments are merely illustrative and the present invention encompasses various changes or corrections that may be within the reach of those skilled in the art within the scope of the invention as defined in the claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A driver circuit comprising:

an input terminal for receiving an input signal;

an output terminal for outputting an output current;

a reference current source circuit including a reference current source that generates a reference current prescribing an amount of change in the output current that corresponds to a change in a unit quantity of said input signal, said reference current source circuit varying a value of said reference current based on said input signal; and an output current generating circuit for generating said output current conforming to said input signal based on said reference current to output said output current at said output terminal, wherein said change in unit quantity of said input signal produces a corresponding change in a current level of said output current, an amount of said change in current level of said output current comprising a predetermined non-linear relationship to said change in unit quantity of said input signal.

2. The driver circuit according to claim 1, wherein said input signal comprises a digital signal; and wherein said change in a unit quantity in the input signal corresponds to a single-bit equivalent of a least significant bit of the digital input signal.

3. The driver circuit according to claim 1, wherein said input signal comprises a digital signal; and wherein said output current generating circuit includes:

a first current generating circuit for generating a first output current corresponding to said input signal based on said reference current source; and a second current generating circuit, including a current source distinct from said reference current source, for generating a second output current corresponding to said input signal;

a current that is a result of combining said first and second output currents being output as said output current from said output terminal.

4. The driver circuit according to claim 3, wherein a range of said input signal from a minimum value to a maximum value is divided into plural intervals; and wherein said first output current is zero at one end of one interval, with said second output current being an output current output from said output terminal.

5. The driver circuit according to claim 4, wherein a current value of the output current that corresponds to at least one end of said interval of the input signal is set to a current value that corresponds to an ideal value of the predetermined non-linear input/output characteristic, and a linear approximation of the non-linear input/output characteristic is performed on a per-interval basis.

6. A driver circuit for a light-emitting element in which an emission of light is controlled in accordance with a supplied current, said driver circuit receiving a video signal that enters from an input terminal, generating a current that corresponds to the video signal and outputting the current from an output terminal, said driver circuit comprising:

a decoder receiving and decoding the video signal composed of plural bits to output the decoded signal;

a first current driver circuit, including a plurality of current sources, respective values of current thereof being decided based upon an applied reference current, and a plurality of switch circuits that on/off control current paths between the plurality of current sources and a current output terminal based upon an output signal of said decoder, for generating and outputting a first output current that corresponds to a value of the video signal;

a second current driver circuit outputting a second output current that corresponds to the value of said video signal; and a reference current source circuit, including a current source that generates the reference current, for varying the output reference current based upon the video signal;

wherein a current that is a result of combining the first and second output currents output from said first and second current driver circuits respectively, is output from the output terminal as an output current; and an amount of change in the output current that corresponds to a change in a unit quantity of the video signal is varied in accordance with the video signal.

7. The driver circuit for a light-emitting element according to claim 6, wherein the unit quantity of the video signal is a single-bit equivalent of a least significant bit of the video signal.

8. The driver circuit for a light-emitting element according to claim 6, wherein said reference current source circuit includes a control circuit for varying a current value of said reference current output based on said video signal.

9. The driver circuit for a light-emitting element according to claim 6, wherein at least one of said first current driver circuit, said second current driver circuit and said reference current source circuit variably controls the output current based on a totality of bits of said video signal.

10. The driver circuit for a light-emitting element according to claim 6, wherein a range of said input signal from a minimum value to a maximum value is divided into plural intervals; and wherein said first output current is zero at one end of one such interval, with said second output current being an output current.

11. The driver circuit for a light-emitting element according to claim 10, wherein a current value of the output current that corresponds to at least one end of said interval of the video signal is set to a current value that corresponds to a logic value of the predetermined non-linear input/output characteristic, and a linear approximation of the non-linear input/output characteristic is performed on a per-interval basis.

12. The driver circuit for a light-emitting element according to claim 6, further comprising a luminance adjustment circuit for varying a control voltage, which is output thereby, based upon a control signal that enters from a control terminal;

wherein said reference current source circuit receives the control voltage output from said luminance adjustment circuit and varies a current value of the output reference current based upon the control voltage.

13. The driver circuit for a light-emitting element according to claim 12, wherein said second current driver circuit varies the current value of said second output current based on said control voltage.

14. The driver circuit for a light-emitting element according to claim 6, wherein said first current driver circuit includes:

a multiple-output current mirror circuit, having an input terminal to which the reference current is input, for outputting currents that mirror the reference current from respective ones of a plurality of output terminals; and a plurality of switching elements, each of which has a control terminal that receives a lower-order bit signal of the video signal or a signal obtained by decoding the lower-order bit signal of the video signal by said decoder, a first end connected to a respective output terminal of the plurality of output terminals of said current mirror circuit, and a second end connected to the current output terminal.

15. The driver circuit for a light-emitting element according to claim 6, wherein said reference current source circuit includes:

a plurality of current sources having first ends connected in common to a first potential;

a decoder for the reference current source circuit, receiving and decoding the video signal; and a plurality of switching elements, which have first ends connected to output terminals of respective ones of said plurality of current sources and second ends connected in common to a reference current output terminal that outputs the reference current, for being on/off controlled based upon a signal that is output from said decoder for the reference current source circuit.

16. The driver circuit for a light-emitting element according to claim 6, wherein said reference current source circuit includes:

one or a plurality of current sources having a first end connected to a first potential and an output terminal connected to a current output terminal that outputs the reference current;

a decoder for the reference current source circuit, receiving and decoding the video signal; and a voltage selection circuit for supplying a bias voltage to said one or plurality of current sources based upon result of decoding by said decoder for the reference current source circuit;

said current source varying the output current from the output terminal of said current source in accordance with the bias voltage.

17. The driver circuit for a light-emitting element according to claim 16, wherein said voltage selection circuit in said reference current source circuit includes:

a decoder for the second current driver circuit, receiving and decoding the video signal;

a resistor circuit, which has a plurality of resistors connected serially between a high reference potential and a low reference potential, for outputting corresponding voltages from a predetermined plurality of taps from among the high reference potential, low reference potential and nodes between mutually adjacent ones of said resistors; and a plurality of switching elements, connected between the plurality of taps of said resistor circuit and an output terminal that outputs the bias voltage, for being on/off controlled by an output signal from said decoder for the second current driver circuit.

18. The driver circuit for a light-emitting element according to claim 15, further comprising a luminance adjustment circuit for generating a variable control voltage based upon a control signal applied thereto;

wherein a control voltage is supplied as the first potential of said current-source circuit.

19. The driver circuit for a light-emitting element according to claim 6, wherein said second current driver circuit further includes:

a decoder for the second current driver circuit, receiving and decoding the video signal;

a first group of current sources having first ends connected in common to a first potential; and a first group of switching elements, having first ends connected to output terminals of respective ones of said first group of current sources and second ends connected in common to a current output terminal, for being on/off controlled based upon a signal from said decoder for the second current driver circuit received at a control terminal thereof.

20. The driver circuit for a light-emitting element according to claim 19, wherein said second current driver circuit further includes:

a second group of current sources having first ends connected in common to a second potential; and a second group of switching elements, having first ends connected to output terminals of respective ones of said second group of current sources and second ends connected in common to a current output terminal, for being on/off controlled based upon a signal from said decoder for the second current driver circuit received at a control terminal thereof.

21. The driver circuit for a light-emitting element according to claim 6, said second current driver circuit includes:

a decoder for the second current driver circuit, receiving and decoding the video signal;

one or a plurality of current sources, each having a first end connected to a first potential and an output terminal connected to a current output terminal that outputs the second output current; and a voltage selection circuit for supplying a bias voltage to said one or plurality of current sources based upon a result of decoding by said decoder;

said current source varying the output current from the output terminal of said current source in accordance with the bias voltage.

22. The driver circuit for a light-emitting element according to claim 21, wherein said second current driver circuit includes:

one or a plurality of current sources, each having a first end connected to a second potential and an output terminal connected to a current output terminal that outputs the second output current; and a voltage selection circuit for supplying a bias voltage to said one or plurality of current sources based upon a result of decoding by said decoder for the second current driver circuit;

said current source varying the output current from the output terminal of said current source in accordance with the bias voltage.

23. The driver circuit for a light-emitting element according to claim 21, wherein said voltage selection circuit includes:

a resistor circuit, having a plurality of resistors serially connected between a high reference potential and a low reference potential, for outputting corresponding voltages from a predetermined plurality of taps from among the high reference potential, low reference potential and nodes between mutually adjacent ones of said resistors; and a plurality of switching elements, connected between the respective plurality of taps of said resistor circuit and an output terminal that outputs the bias voltage, for being on/off controlled by an output signal from said second decoder.

24. The driver circuit for a light-emitting element according to claim 21, further comprising a luminance adjustment circuit for generating a variable control voltage, which is output thereby, based upon a control signal applied thereto from a control signal input terminal;

wherein the control voltage that is output from said luminance adjustment circuit is supplied as the first potential of said second current driver circuit.

25. The driver circuit for a light-emitting element according to claim 22, further comprising a luminance adjustment circuit for generating a variable control voltage, which is output thereby, based upon a control signal applied thereto from a control signal input terminal;

wherein the control voltage that is output from said luminance adjustment circuit is supplied as the second potential of said second current driver circuit.

26. The driver circuit for a light-emitting element according to claim 11, wherein the non-linear input/output characteristic is made a prescribed gamma-value characteristic, and the output current produced is one obtained by correcting the video signal in accordance with the predetermined gamma value.

27. A display device having the driver circuit for a light-emitting element set forth in claim 6 as a driver circuit for driving a display element of a display-element panel, wherein it is unnecessary to provide a gamma correction circuit in front of said driver circuit for driving the display element.

28. A display device comprising:

a display panel having a plurality of scan lines arrayed along a horizontal direction, a plurality of data lines arrayed along a vertical direction and a plurality of display elements provided at intersections of said scan lines and data lines;

a scan driver for driving the scan lines; and a data driver, receiving a video signal, for driving the data lines;

wherein said data driver has the driver circuits for light-emitting elements set forth in claim 6 as driver circuits for driving the data lines.

29. The display device according to claim 28, wherein said drivers for light-emitting elements, which are provided in a correspondence with colors of the light-emitting elements, are controlled individually on a per-color basis to uniformalize a panel luminance.

30. A semiconductor device having the driver circuit set forth in claim 1.

31. A current-output-type digital-to-analog converter, receiving a digital signal as an input for converting the digital signal to an output current and outputting the output current, said converter comprising:

a first current driver circuit, having a plurality of current sources in which values of current to be output are decided based upon an applied reference current, and a plurality of switch circuits that on/off control current paths between the plurality of current sources and a current output terminal based upon the input signal of multiple bits, for generating and outputting a first output current that conforms to the input signal of multiple bits;

a second current driver circuit, for generating and outputting a second output current correcting the output current in accordance with the input signal; and a reference current-source circuit for outputting the reference current, and for varying the reference current based upon a value of the input signal;

wherein a current that is a result of combining the first and second output currents output from said first and second current driver circuits respectively, is output as the output current; and an amount of change in the output current that corresponds to a change in a unit quantity of the digital signal is varied in accordance with the value of the input signal.

* * * * *